US007059836B2

(12) United States Patent
Takagi et al.

(10) Patent No.: US 7,059,836 B2
(45) Date of Patent: Jun. 13, 2006

(54) PUMP

(75) Inventors: Kunihiko Takagi, Okaya (JP); Takeshi Seto, Chofu (JP)

(73) Assignee: Seiko Epson Corporation, Tokyo (JP)

( * ) Notice: Subject to any disclaimer, the term of this patent is extended or adjusted under 35 U.S.C. 154(b) by 421 days.

(21) Appl. No.: 10/447,160

(22) Filed: May 29, 2003

(65) Prior Publication Data

US 2004/0013539 A1 Jan. 22, 2004

(30) Foreign Application Priority Data

Jun. 3, 2002 (JP) ..... 2002-161817
Nov. 11, 2002 (JP) ..... 2002-326914

(51) Int. Cl.
*F04B 17/03* (2006.01)

(52) U.S. Cl. ..... 417/44.2; 417/413.2; 417/557

(58) Field of Classification Search ..... 417/44.2, 417/413.1, 413.2, 557
See application file for complete search history.

(56) References Cited

U.S. PATENT DOCUMENTS

| | | | | |
|---|---|---|---|---|
| 5,769,608 | A | 6/1998 | Seale | |
| 6,074,178 | A * | 6/2000 | Bishop et al. | 417/413.2 |
| 6,104,127 | A | 8/2000 | Kameyama et al. | |
| 6,109,889 | A | 8/2000 | Zengerle et al. | |
| 6,203,291 | B1 | 3/2001 | Stemme et al. | |
| 6,227,809 | B1 | 5/2001 | Forster et al. | |
| 6,280,148 | B1 | 8/2001 | Zengerle et al. | |
| 6,604,909 | B1 * | 8/2003 | Schoenmeyr | 417/44.2 |
| 6,623,256 | B1 * | 9/2003 | Takagi et al. | 417/413.2 |
| 6,716,002 | B1 * | 4/2004 | Higashino | 417/413.2 |
| 2002/0009374 | A1 | 1/2002 | Higashino | |

FOREIGN PATENT DOCUMENTS

DE 25 19 962 11/1976

(Continued)

OTHER PUBLICATIONS

N.T. Nguyen et al.; "Hybrid-assembled micro dosing system using silicon-based micropump/valve and mass flow sensor"; Sensors and Actuators A 69; 1998; pp. 85-91.

(Continued)

*Primary Examiner*—Michael Koczo, Jr.
(74) *Attorney, Agent, or Firm*—Oliff & Berridge, PLC

(57) ABSTRACT

The invention provides a pump which has reduced pressure loss by using fewer mechanical on-off valves, which has increased reliability, which can be used under a high load pressure, which can be driven at a high frequency, and which has good drive efficiency by increasing discharge fluid volume per pumping period. A circular diaphragm, disposed at the bottom portion of a case, has its outer peripheral edge secured to and supported by the case. A piezoelectric device to move the diaphragm is disposed at the bottom surface of the diaphragm. A space between the diaphragm and the top wall of the case is a pump chamber. An inlet flow path, having a check valve serving as a fluid resistor disposed thereat, and an outlet flow path, which opens to the pump chamber during operation of the pump, open towards the pump chamber. In the pump, driving of the piezoelectric device is controlled so that an average displacement velocity in a pump chamber volume reducing step of the diaphragm becomes a velocity at which the diaphragm reaches the reached-displacement-position in a time equal to or less than ½ and equal to or greater than 1/10 of a natural vibration period T of fluid inside the pump chamber and the outlet flow path.

11 Claims, 13 Drawing Sheets

FOREIGN PATENT DOCUMENTS

| | | | |
|---|---|---|---|
| DE | 44 22 743 | A1 | 1/1996 |
| DE | 197 06 513 | A1 | 8/1998 |
| DE | 197 11 270 | A1 | 9/1998 |
| EP | 0 844 395 | A2 | 5/1998 |
| EP | 0 844 478 | A1 | 5/1998 |
| EP | 1 236 900 | A1 | 9/2002 |
| GB | 741015 | | 11/1955 |
| JP | A 8-506874 | | 7/1996 |
| JP | A 8-312537 | | 11/1996 |
| JP | A 10-220357 | | 8/1998 |

OTHER PUBLICATIONS

Nam-Trung Nguyen et al.; "Integrated flow sensor for in situ measurement and control of acoustic streaming in flexural plate wave micropumps"; Sensors and Acutuators 79; 2000; pp. 115-121.

Olsson et al., An Improved Valve-Less Pump Fabricated Using Deep Reactive Ion Etching, 1996, IEEE, 479-484.

* cited by examiner

PUMP

BACKGROUND OF THE INVENTION

1. Field of Invention

The present invention relates to a positive displacement pump to move fluid by changing the volume inside a pump chamber by, for example, a piston or a diaphragm. More particularly, the invention relates to a highly reliable pump having a high flow rate.

2. Description of Related Art

Such a related art pump of this type generally has a structure that includes a check valve mounted between an inlet flow path and a pump chamber whose volume can be changed and between an outlet flow path and the pump chamber, as disclosed in Japanese Unexamined Patent Application Publication No. 10-220357 (JP 357).

The related art also includes a pump structure to cause fluid to flow in one direction by making use of viscosity resistance of the fluid. This structure includes a valve at an outlet flow path. In this structure, fluid resistance at an inlet flow path is greater than at the outlet flow path when the valve is opened, as disclosed in Japanese Unexamined Patent Application Publication No. 08-312537 (JP 537).

The related art also includes a pump structure which makes it possible to increase reliability of a pump without using a movable part for a valve. This structure includes a compressive structural device having an inlet flow path and an outlet flow path with shapes in which a pressure drop differs depending on the direction of fluid flow, as disclosed in Published Japanese Translation of PCT International Publication for Patent Application No. 08-506874 of (JP 874), and Anders Olsson, "An Improved Valve-Less Pump Fabricate Using Deep Reactive Ion Etching," 1996, IEEE $9^{th}$ International Workshop on Microelectromechanical Systems, pp. 479 to 484 (Olsson).

SUMMARY OF THE INVENTION

However, in the structure disclosed in JP 357, a check valve is required at both the inlet flow path and at the outlet flow path, so that, when fluid passes through the two check valves, pressure loss is large. In addition, since the check valves repeatedly open and close, they may get fatigued and damaged, so that the larger the number of check valves used, the less the reliability of the pump.

In the structure disclosed in JP 537, to reduce back flow that occurs at the inlet flow path at the time of a pump discharge step, fluid resistance at the inlet flow path needs to be large. When it is made large, since, in a pump suction step, fluid enters the pump chamber by opposing the fluid resistance, the suction step is considerably longer than the discharge step. Therefore, frequency of a discharge-suction cycle of the pump becomes considerably low.

In pumps in which a piston or a diaphragm is moved vertically, when the area of the piston or diaphragm is the same, in general, the higher the frequency for vertical movement, the higher the flow rate, and, thus, the output. However, in the structure disclosed in JP 537, since, as mentioned above, the pump can only be driven at a low frequency, a small pump having a high output cannot be provided.

In the structure disclosed in JP 874, since the net flow rate is made unidirectional by a difference between pressure drops that depends upon the direction of flow of the fluid that passes the compressive structural device in accordance with an increase or decrease of the volume of the pump chamber, back flow increases as external pressure (load pressure) at the outlet side of the pump increases, and, at high load pressure, pumping operation is no longer carried out. According to Olsson, the maximum load pressure is of the order of 0.760 atmospheres.

To address or solve the above and/or other problems, the present invention provides a pump which has reduced pressure loss by using fewer mechanical on-off valves, which has increased reliability, which can be used at a high load pressure, which can be driven at a high frequency, and which has good drive efficiency by increasing discharge fluid volume per pumping period.

To address or overcome the above, a pump is provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The outlet flow path is opened to the pump chamber during operation of the pump. A combined inertance value of the at least one inlet flow path is smaller than a combined inertance value of the at least one outlet flow path. The inlet flow path has a fluid resistor to cause a resistance of the operating fluid to be smaller when the operating fluid flows into the pump chamber than when the operating fluid flows out of the pump chamber.

The driving device controls the driving of the actuator so that an average displacement velocity in a pump chamber volume reducing step of the movable wall becomes a velocity at which the movable wall reaches the reached-displacement-position in a time equal to or less than ½ of a natural vibration period of the fluid in the pump chamber and the outlet flow path.

An inertance $L=\rho\times 1/S$, where S is the cross-sectional area of a flow path, 1 is the length of a flow path, and $\rho$ is the density of an operating fluid. When the difference between pressures in the flow paths is $\Delta P$ and the flow rate of a fluid flowing in a flow path is Q, and when a formula for determining movement of a fluid inside a flow path is transformed using the inertance L, the relationship $\Delta P=L\times dQ/dt$ is derived. In other words, the inertance L indicates the degree of influence of unit pressure on changes in flow rate with time. The larger the inertance L, the smaller the change in the flow rate with time, whereas, the smaller the inertance L, the larger the change in the flow rate with time.

A combined inertance of a plurality of flow paths connected in parallel and a combined inertance of a plurality of flow paths having different shapes connected in series are calculated by combining the inertances of the individual flow paths in the same way as inductances of component parts connected in parallel and those connected in series in an electric circuit are combined and calculated, respectively.

The inlet flow path refers to a flow path up to an end surface at a fluid entrance side of an inlet connecting duct. However, when a pulsation absorbing device is connected in the connecting duct, the inlet flow path refers to a flow path to a connection portion with the pulsation absorbing device from the inside of the pump chamber. When a plurality of pump inlet flow paths merge, the inlet flow paths refer to flow paths from the inside of the pump chamber to a merging portion of the inlet flow paths. What has been mentioned similarly applies to the outlet flow path.

The reached-displacement-position of the movable wall refers to that when the volume of the pump chamber is the smallest during driving of the pump.

Since the combined inertance of the at least one inlet flow path is smaller than the combined inertance of the at least one outlet flow path, fluid in the inlet flow paths flows with a high rate of change in fluid velocity, so that a suction fluid volume (=a discharge fluid volume) can be increased.

By controlling the driving of the actuator so that an average displacement velocity in a pump chamber volume reducing step of the diaphragm is equal to or greater than a velocity at which the diaphragm reaches the reached-displacement-position in a time equal to or less than ½ of a natural vibration period T of the fluid in the outlet flow path and the pump chamber, a limited amount of displacement of the movable wall can be effectively used, thereby making it possible to increase the flow rate.

In the invention, the driving device controls the driving of the actuator so that an average displacement velocity in at least a half or more than half of the whole step of the movable wall in a direction in which the volume of the pump chamber is reduced becomes a velocity at which the movable wall reaches the reached-displacement-position in a time equal to or less than ½ of a natural vibration period of the fluid in the pump chamber and the outlet flow path. By such a controlling operation, even if the actuator is driven with a displacement velocity being set as a suitable function of time, a limited amount of displacement of the movable wall can be effectively used, thereby making it possible to increase the flow rate.

The driving device drives the actuator so that the average displacement velocity of the movable wall becomes a velocity at which the movable wall reaches the reached-displacement-position in a time equal to or greater than 1/10 of the natural vibration period of the fluid in the pump chamber and the outlet flow path.

The durability of the movable wall and the fluid resistor can be increased.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The outlet flow path is opened to the pump chamber during operation of the pump. A combined inertance value of the at least one inlet flow path is smaller than a combined inertance value of the at least one outlet flow path. The inlet flow path has a fluid resistor for causing a resistance of the operating fluid to be smaller when the operating fluid flows into the pump chamber than when the operating fluid flows out of the pump chamber.

The driving device performs a controlling operation to displace the movable wall in a direction in which the volume of the pump chamber is increased subsequent to a passage of time equal to ½ of a natural vibration period of the fluid inside the pump chamber and the outlet flow path from the start of movement of the movable wall in a direction in which the volume of the pump chamber is reduced.

Since the diaphragm can return to its state before displacement without reducing discharge flow rate, the discharge fluid volume per cycle can be increased.

On the other hand, a pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The outlet flow path is opened to the pump chamber during operation of the pump. A combined inertance value of the at least one inlet flow path is smaller than a combined inertance value of the at least one outlet flow path. The inlet flow path has a fluid resistor to cause a resistance of the operating fluid to be smaller when the operating fluid flows into the pump chamber than when the operating fluid flows out of the pump chamber.

The driving device includes a displacement controlling device to control movement of the movable wall based on detection information from a pump pressure detecting device to detect pressure inside the pump. According to the invention, by causing the displacement controlling device to control the movement of the movable wall in accordance with the pressure inside the pump as appropriate, the discharge fluid volume per pumping period is increased, so that it is possible to provide a pump with high drive efficiency.

It is desirable that the displacement controlling device measure time up to when the pump pressure detecting device detects a predetermined pressure change after completion of the displacement of the movable wall for one period, and control the movement of the movable wall in the next period based on information of the measured time.

It is desirable that the displacement controlling device control the movement of the movable wall so that the measured time becomes long.

It is desirable that the displacement controlling device control the movement of the movable wall based on a calculation value using a predetermined value and a value detected by the pump pressure detecting means.

It is desirable that the calculation value be a value resulting from time-integrating a difference between the value detected by the pump pressure detecting device and the predetermined value for a period in which the value detected by the pump pressure detecting device is equal to or greater than the predetermined value.

It is desirable that the displacement controlling device control the movement of the movable wall so that the calculation value becomes large.

It is desirable that the displacement controlling device control a displacement velocity in the pump chamber volume reducing step of the movable wall.

It is desirable that the displacement controlling device control the displacement velocity in the pump chamber volume reducing step of the movable wall by changing a displacement time with the reached-displacement-position of the movable wall being the same.

It is desirable that the displacement controlling device perform a controlling operation so that the movable wall is displaced in a direction in which the volume of the pump chamber is increased after a reduction in the pressure detected by the pump pressure detecting means to a value less than a predetermined value.

The displacement controlling device can set a fall timing at the time of displacing the movable wall in the direction in which the pump chamber volume increases so as to increase discharge fluid volume per pumping period without reducing discharge flow rate. Therefore, it is possible to provide a pump having good drive efficiency.

It is desirable that the predetermined value be equal to pressure inside the pump chamber measured by the pump pressure detecting device prior to driving the actuator.

It is desirable that the predetermined value be a value measured by the pump pressure detecting device when the driving of the actuator is temporarily stopped.

It is desirable that the predetermined value is a previously inputted value substantially equivalent to a load pressure at a location downstream from the outlet flow path.

It is desirable that the driving device further include a load pressure detecting device to detect a load pressure at a location downstream from the outlet flow path, and the predetermined value be a value measured by the load pressure detecting device.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The outlet flow path is opened to the pump chamber during operation of the pump. A combined inertance value of the at least one inlet flow path is smaller than a combined inertance value of the at least one outlet flow path. The inlet flow path has a fluid resistor to cause a resistance of the operating fluid to be smaller when the operating fluid flows into the pump chamber than when the operating fluid flows out of the pump chamber.

The driving device includes a displacement controlling device to control movement of the movable wall based on detection information from a flow velocity measuring device to detect flow velocity at a downstream side including the outlet flow path.

When the displacement controlling device sets the movement of the movable wall as appropriate based on detection information from the flow velocity measuring device to detect flow velocity at a downstream side including the outlet flow path, discharge fluid volume per pumping period is increased, so that it is possible to provide a pump having good drive efficiency.

It is desirable that the displacement controlling device control the movement of the movable wall by a difference between a maximum flow velocity and a minimum flow velocity measured by the flow velocity measuring device.

It is desirable that the displacement controlling device control a displacement velocity in a pump chamber volume reducing step of the movable wall.

It is desirable that the displacement controlling device control the displacement velocity by changing a displacement time with the reached-displacement-position of the movable wall being the same.

It is desirable that the displacement controlling device perform a controlling operation so that the movable wall is displaced in a direction in which the volume of the pump chamber is increased after the flow velocity starts decreasing by the detection information from the flow velocity measuring device.

Since the diaphragm can return to its state prior to displacement without reducing discharge flow rate, it is possible to increase discharge fluid volume per cycle.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The outlet flow path is opened to the pump chamber during operation of the pump. A combined inertance value of the at least one inlet flow path is smaller than a combined inertance value of the at least one outlet flow path. The inlet flow path has a fluid resistor to cause a resistance of the operating fluid to be smaller when the operating fluid flows into the pump chamber than when the operating fluid flows out of the pump chamber.

The driving device includes a displacement controlling device to change movement of the movable wall in a direction in which the volume of the pump chamber is reduced based on detection information from a moving fluid volume measuring device to detect either suction volume at the inlet flow path or discharge volume at the outlet flow path.

When the displacement controlling device sets the movement of the movable wall as appropriate based on the detection information from the moving fluid volume measuring device, discharge fluid volume per pumping period is increased, so that it is possible to provide a pump having good drive efficiency.

It is desirable that the displacement controlling device control a displacement velocity in a pump chamber volume reducing step of the movable wall.

It is desirable that the displacement controlling device control the displacement velocity by changing a displacement time with the reached-displacement-position of the movable wall being the same.

It is desirable that the actuator be a piezoelectric device.

It is desirable that the actuator be a giant magnetostrictive device.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The inlet flow path has a fluid resistor to cause a resistance of the operating fluid to be smaller when the operating fluid flows into the pump chamber than when the operating fluid flows out of the pump chamber. The driving device drives the actuator so that, during a pump chamber volume reducing step or when the movable wall is stopped at the reached-displacement-position, pressure inside the pump becomes equal to or less than a general suction-side pressure.

It is possible to reduce the pressure inside the pump to a value close to the suction-side pressure by the movement of the movable wall in the direction in which the pump chamber volume is reduced. Therefore, in the subsequent pump chamber volume increasing step, almost all of the displacement amount of the movable wall can be used to suck fluid into the pump chamber while maintaining the pressure inside the pump chamber lower than the suction-side pressure, so that the limited amount of displacement of the actuator can be effectively made use of, thereby making it possible to increase flow rate.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The inlet flow path has a fluid resistor to cause a resistance of the operating fluid to be smaller when the operating fluid flows into the pump chamber than when the operating fluid flows out of the pump chamber. The driving device drives the actuator so that a maximum pressure inside the pump becomes equal to or greater than a value equal to twice a load pressure minus a suction-side pressure.

By pressure vibration inside the pump caused by driving of the actuator, it is possible to reduce the pressure inside the pump to a value close to the suction-side pressure. Therefore, by the displacement of the movable wall in the direction in which the volume of the pump chamber increases, the pressure inside the pump is made less than the suction-side pressure, so that fluid can be sucked into the pump chamber.

The driving device drives the actuator so that the maximum pressure inside the pump becomes equal to or greater than twice the load pressure. Accordingly, since the pressure inside the pump can reliably be made lower than the suction-side pressure, in the subsequent pump chamber volume increasing step, the limited amount of displacement of the actuator is effectively made use of, thereby making it possible increase flow rate, which is desirable.

A pump can also be provided that includes an actuator to displace a movable wall, such as a piston or a diaphragm; a driving device to control driving of the actuator; a pump chamber whose volume is changeable by the displacement of the movable wall; at least one inlet flow path to allow an operating fluid to flow into the pump chamber; and at least one outlet flow path to allow the operating fluid to flow out of the pump chamber.

The inlet flow path has a fluid resistor to cause a resistance of the operating fluid to be smaller when the operating fluid flows into the pump chamber than when the operating fluid flows out of the pump chamber. The driving device drives the actuator so that a time during which pressure inside the pump is less than a suction-side pressure is equal to or greater than 60% of one period of movement of the diaphragm.

The suction time in the pump becomes long, so that a larger amount of fluid can be sucked into the pump chamber from the inlet flow path.

A combined inertance of the at least one inlet flow path is smaller than a combined inertance of the at least one outlet flow path, so that discharge flow rate can be increased, which is desirable.

It is desirable that the outlet flow path be opened to the pump chamber during operation of the pump.

The driving device drives the actuator so that, when the pressure inside the pump is less than the general suction-side pressure, the movable wall moves through substantially the whole step in a direction in which the volume of the pump chamber is increased. Therefore, the limited amount of displacement of the actuator is effectively made use of, thereby making it possible to increase flow rate.

It is desirable that the actuator be a piezoelectric device.

It is desirable that the actuator be a giant magnetostrictive device.

DETAILED DESCRIPTION OF PREFERRED EMBODIMENTS

Hereunder, a description of exemplary embodiments of the present invention is provided based on the drawings.

First, the structure of a pump of a first exemplary embodiment of the present invention is described with reference to FIG. 1.

Figure 1:
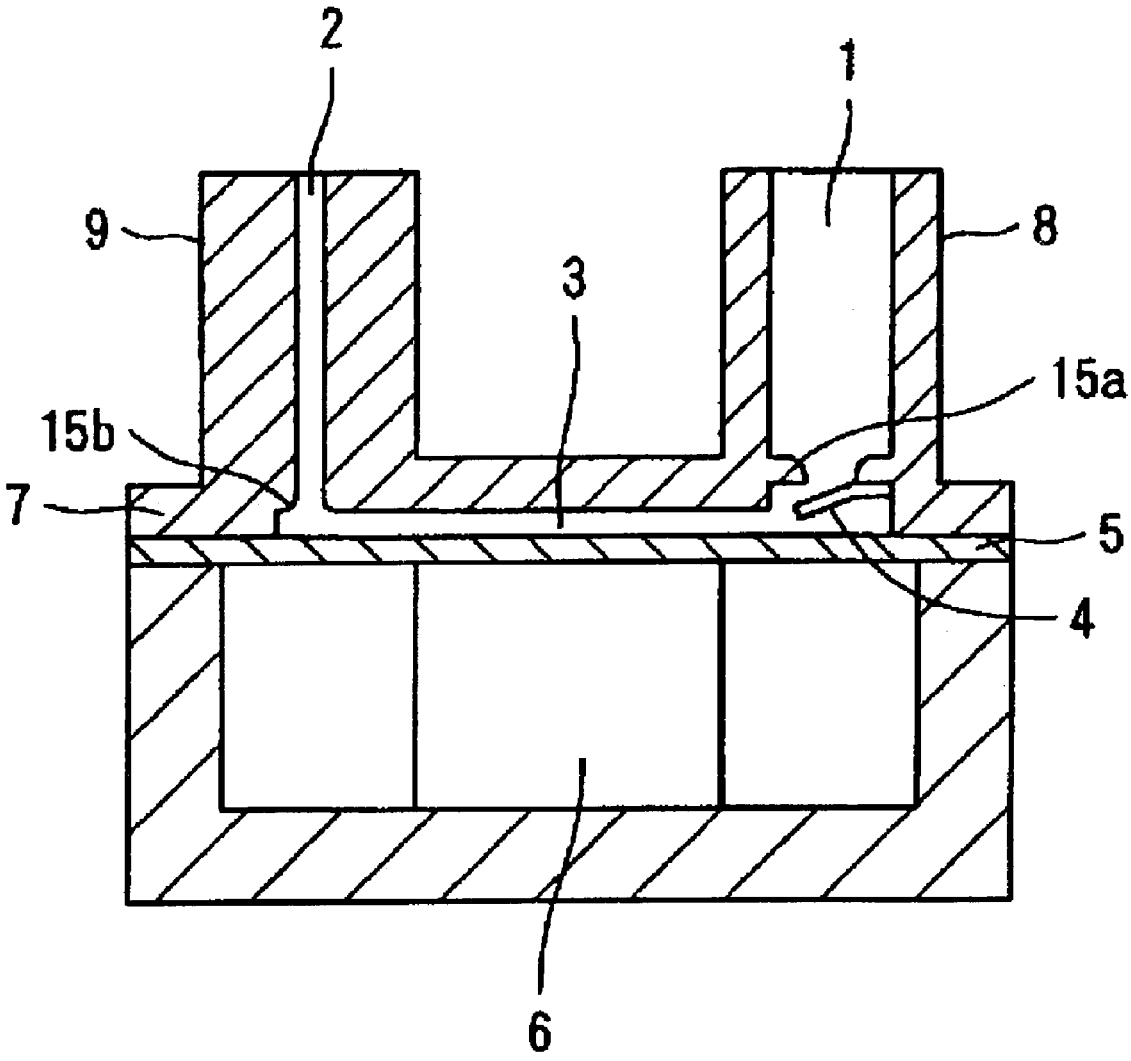
FIG. 1 is a vertical sectional view of a structure of a pump of a first exemplary embodiment of the present invention.

FIG. 1 is a vertical sectional view of the pump of the present invention. A circular diaphragm 5 is disposed at the bottom portion of a circular cylindrical case 7. The outer peripheral edge of the diaphragm 5 is secured to and supported at the case 7 so as to be elastically deformable. A piezoelectric device 6 which serves as an actuator to move the diaphragm 5 and which expands and contracts vertically in FIG. 1 is disposed at the bottom surface of the diaphragm 5.

A narrow space between the diaphragm 5 and the top wall of the case 7 is a pump chamber 3. An inlet flow path 1, which has a check valve 4 that is a fluid resistor provided thereat, and an outlet flow path 2, which is a conduit having a small hole that always opens to the pump chamber even during operation of the pump, open towards the pump chamber 3. A portion of the outer periphery of a part that forms the inlet flow path 1 is an inlet connecting duct 8 to connect an external device (not shown) to the pump. A portion of the outer periphery of a part that forms the outlet flow path 2 is an outlet connecting duct 9 to connect an external device (not shown) to the pump. The inlet flow path and the outlet flow path have rounding portions 15*a* and 15*b* where an entrance-side of an operating fluid is rounded, respectively.

An inertance L will be defined. When the cross-sectional area of a flow path is S, the length of a flow path is 1, and the density of an operating fluid is ρ, L=ρ×1/ S. When the difference between pressures in the flow paths is ΔP and the flow rate of a fluid flowing in a flow path is Q, and when a formula to determine movement of a fluid inside a flow path is transformed using the inertance L, the relationship ΔP=L×dQ/dt is derived.

In other words, the inertance L indicates the degree of influence of unit pressure on changes in flow rate with time. The larger the inertance L, the smaller the change in the flow rate with time, whereas, the smaller the inertance L, the larger the change in the flow rate with time.

A combined inertance of a plurality of flow paths connected in parallel and a combined inertance of a plurality of flow paths having different shapes connected in series are calculated by combining the inertances of the individual flow paths in the same way as inductances of component parts connected in parallel and those connected in series in an electric circuit are combined and calculated, respectively.

Here, the inlet flow path refers to a flow path up to an end surface at a fluid entrance side of the inlet connecting duct 8 from inside the pump chamber 3. However, when a pulsation absorbing device is connected in the connecting duct, the inlet flow path refers to a flow path to a connection portion with the pulsation absorbing device from the inside of the pump chamber. When a plurality of pump inlet flow paths 1 merge, the inlet flow paths refer to flow paths from the inside of the pump chamber 3 to a merging portion of the inlet flow paths. What has been mentioned similarly applies to the outlet flow path.

With reference to FIG. 1, the symbols of the lengths and areas of the inlet flow path 1 and the outlet flow path 2 will be described. In the inlet flow path 1, the length and area of a small-diameter duct portion near the check valve 4 are L1 and S1, respectively, and the length and area of the remaining large-diameter duct portion are L2 and S2, respectively. In the outlet flow path 2, the length and area of the duct of the outlet flow path 2 are L3 and S3, respectively.

Using these symbols and the density ρ of an operating fluid, the relationship between the inertances of the inlet flow path 1 and the outlet flow path 2 will be described.

The combined inertance of the inlet flow path 1 is calculated by ρ×L1/S1 +ρ×L2/S2. On the other hand, the combined inertance of the outlet flow path 2 is calculated by ρ×L3/S3. These flow paths are formed with sizes that satisfy the relationship ρ×L1/S1 +ρ×L2/S1 <ρ×L3/S3.

In the above-described structure, the shape of the diaphragm 5 is not limited to a spherical shape. In addition, for example, to protect structural parts of the pump from excessive load pressure that may be exerted when the pump stops, a valve element may be disposed at the outlet flow path 2 as long as the outlet flow path 2 is opened to the pump chamber at least when the pump is operating. Further, the check valve 4 may be not only of a type which performs an opening-closing operation by a pressure difference of a fluid, but also of a type that can control an opening-closing operation by a force other than that produced by a pressure difference of a fluid.

Any type of actuator may be used as the actuator 6 to move the diaphragm 5 as long as it expands and contracts. In the pump structure of the present invention, the actuator and the diaphragm 5 are connected without a displacement enlarging mechanism, so that the diaphragm can be operated at a high frequency. Therefore, by using the piezoelectric device 6 having a high response frequency as in the exemplary embodiment, it is possible to increase flow rate by high-frequency driving, so that a small pump with a high output can be provided. Similarly, a giant magnetostrictive device having a high frequency characteristic may be used.

Since a mechanical on-off valve only needs to be disposed at a suction side, a reduction in the flow rate by a valve is reduced, thereby increasing reliability.

The movement of the diaphragm in the first exemplary embodiment is described below using FIGS. 2 to 5.

Figure 2:
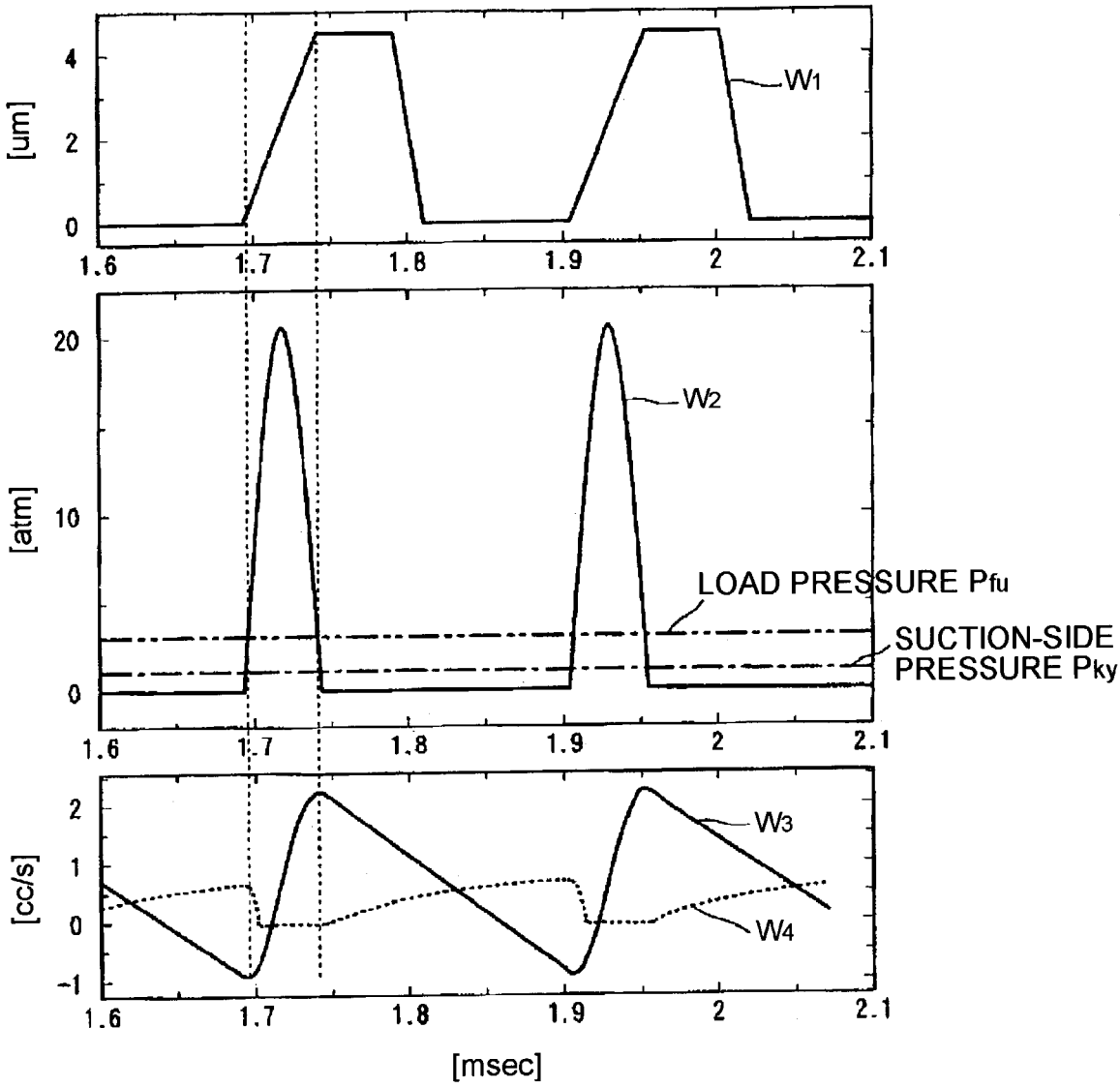
FIG. 2 shows graphs of state quantities during operation of the pump of the first exemplary embodiment.

FIG. 2 shows waveforms when the pump has been operated, that is, a waveform W1 of a displacement of the diaphragm 5, a waveform W2 of an internal pressure of the pump chamber 3, a waveform W3 of a volume velocity of a fluid passing the outlet flow path 2 (that is, cross-sectional area of the outlet duct×velocity of fluid; in this case, the volume velocity is equivalent to the flow rate), and a waveform W4 of a volume velocity of a fluid passing the check valve 4. A load pressure $P_{fu}$ shown in FIG. 2 is a fluid pressure at a location downstream from the outlet flow path 2, while a suction-side pressure $P_{ky}$ is a fluid pressure at a location upstream from the inlet flow path 1.

As indicated by the waveform W1 of the displacement of the diaphragm 5, an area in which the inclination of the waveform is positive corresponds to a process in which the piezoelectric device 6 expands and reduces the volume of the pump chamber 3. An area in which the inclination of the waveform is negative corresponds to a process in which the piezoelectric device 6 contracts and increases the volume of the pump chamber 3.

Each smooth waveform interval in which the diaphragm 5 is displaced by approximately 4.5 μm corresponds to the reached-displacement-position of the diaphragm 5, that is, the displacement position of the diaphragm 5 where the volume of the pump chamber 3 becomes a minimum.

As indicated by the waveform W2 of the change in the internal pressure of the pump chamber 3, when the volume of the pump chamber 3 starts to decrease, the internal pressure of the pump chamber 3 starts to increase. Before completion of the reduction in the volume of the pump chamber 3, the internal pressure of the pump chamber 3 has reached its maximum value and is starting to decrease. The point where the internal pressure is a maximum corresponds to a point where a volume velocity of fluid displaced by the diaphragm 5 and the volume velocity of fluid in the outlet flow path 2, indicated by the waveform 3, become equal.

This is because, since, before this time, the volume velocity of the displacement fluid−the volume velocity of the fluid in the outlet fluid path 2>0, the fluid inside the pump chamber 3 is compressed accordingly, so that the pressure inside the pump chamber 3 is increased, whereas, after this time, the volume velocity of the displacement fluid−the volume velocity of the fluid in the outlet fluid path 2<0, so that the amount of compression on the fluid inside the pump chamber 3 is reduced accordingly, thereby causing the pressure inside the pump chamber 3 to be reduced.

When a change in the volume of the fluid inside the pump chamber 3 at each of these times is ΔV, the pressure inside the pump chamber 3 changes in accordance with the relationship between the compressibility of the fluid and an equation ΔV=volume of fluid displaced by diaphragm+suction fluid volume−discharge fluid volume. Therefore, even when the volume of the pump chamber 3 is decreasing, the pressure inside the pump chamber 3 may be less than the load pressure $P_{fu}$.

In the case shown in FIG. 2, when the pressure inside the pump chamber 3 becomes less than the suction-side pressure $P_{ky}$ and reaches a value close to absolute zero atmospheres, components dissolved in the operating fluid are turned into gases and bubble, so that aeration and cavitation occur. It is saturated at a pressure near absolute zero atmospheres. However, when pressure is applied to the entire flow path system including the pump, and the suction-side pressure $P_{ky}$ is sufficiently high, aeration and cavitation may not occur.

In the outlet flow path 2, as indicated by the waveform W3 of the volume velocity of the fluid in the outlet flow path 2, a period where the pressure inside the pump chamber 3 is greater than the load pressure $P_{fu}$ substantially corresponds to a period in which the volume velocity of the fluid is increasing. When the pressure inside the pump chamber 3 is less than the load pressure $P_{fu}$, the volume velocity of the fluid inside the outlet flow path 2 starts to decrease.

When the difference between the pressure inside the pump chamber 3 and the load pressure $P_{fu}$ is $\Delta P_{out}$, the fluid resistance in the outlet flow path 2 is $R_{out}$, the inertance is $L_{out}$, and the volume velocity of the fluid is $Q_{out}$, the following Formula (1) regarding the fluid inside the outlet flow path 2 is established:

[Formula 1] (1)

$$\Delta P_{out} = R_{out} Q_{out} + L_{out} \frac{dQ_{out}}{dt}$$

Therefore, the rate of change in the volume velocity of the fluid is equal to the difference between $P_{out}$ and $R_{out} \times Q_{out}$ divided by the inertance $L_{out}$. A value obtained by integrating the volume velocity of the fluid, indicated by the waveform W3, for one period becomes the discharge fluid volume per period.

As indicated by the waveform W4 of the change in the volume velocity of the fluid passing the check valve 4, in the inlet flow path 1, when the pressure inside the pump chamber 3 becomes less than the suction-side pressure $P_{ky}$, the check valve 4 opens due to the pressure difference, so that the volume velocity of the fluid starts to increase. When the pressure inside the pump chamber 3 increases to a value greater than the suction-side pressure $P_{ky}$, the volume velocity of the fluid starts to decrease. The operation of the check valve 4 prevents back flow.

When the difference between the pressure inside the pump chamber 3 and the suction-side pressure $P_{ky}$ is $\Delta P_{in}$, the fluid resistance in the outlet fluid path 2 is $R_{in}$, the inertance is $L_{in}$, the volume velocity of the fluid is $Q_{in}$, the following Formula (2) for the fluid inside the inlet flow path 1 is established:

[Formula 2] (2)

$$\Delta P_{in} = R_{in} Q_{in} + L_{in} \frac{dQ_{in}}{dt}$$

Therefore, the rate of change in the fluid volume velocity is equal to the difference between $\Delta P_{in}$ and $R_{in} \times Q_{in}$ divided by the inertance $L_{in}$ in the inlet flow path 1.

A value obtained by integrating the volume velocity of the fluid indicated by the waveform W4 for one period becomes the suction fluid volume per period. The suction fluid volume is equal to the discharge fluid volume calculated by the waveform W3.

In the pump structure in the exemplary embodiment, since the inertance of the inlet flow path 1 is smaller than the inertance of the outlet flow path 2, the fluid inside the inlet flow path 1 flows in with a high rate of change in the fluid velocity, so that the suction fluid volume (=discharge fluid volume) can be increased.

Figure 3:
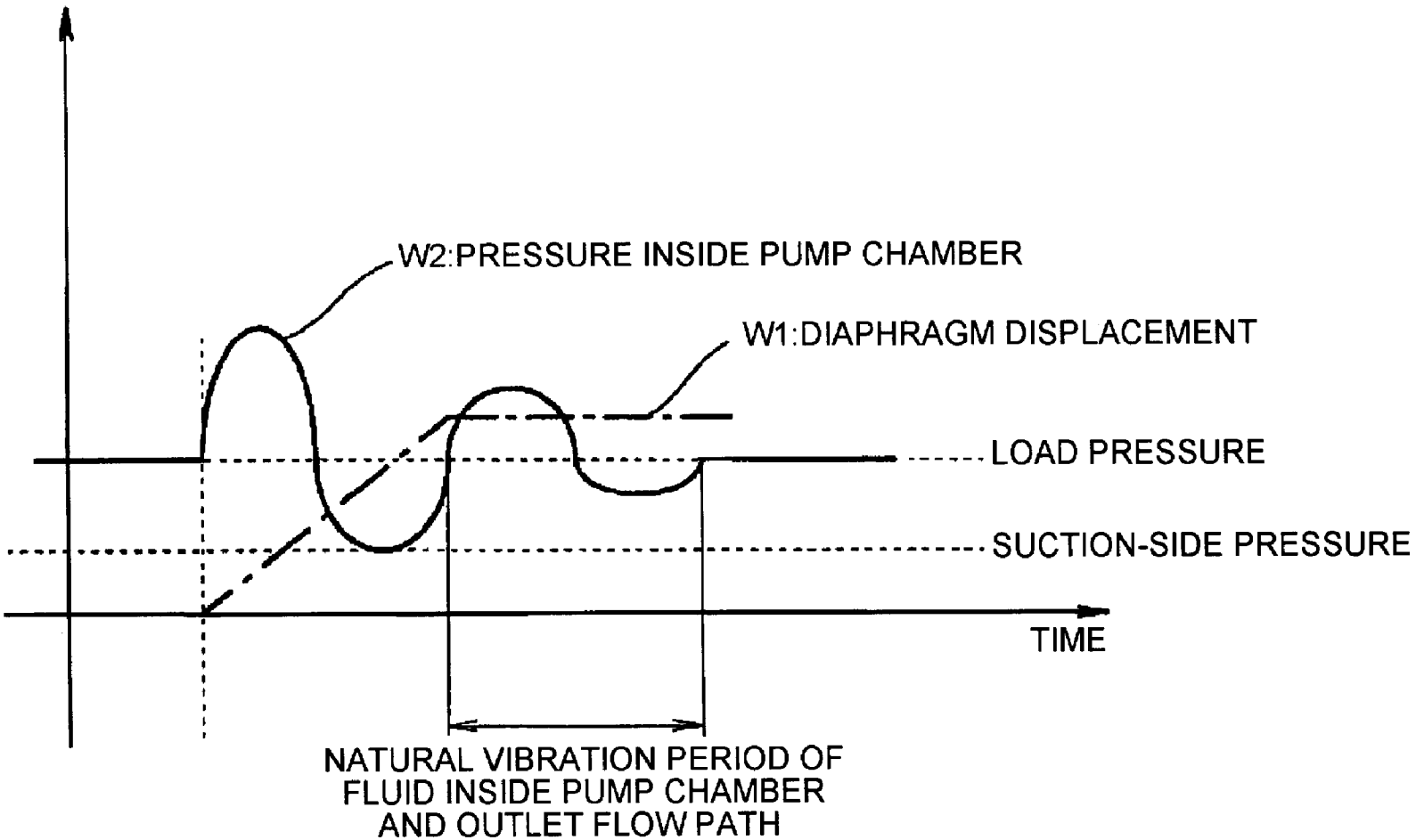
FIG. 3 shows a graph of a state in which the pressure inside a pump chamber is not sufficiently increased with the time to reduce the volume of the pump chamber being long.

FIG. 3 illustrates waveforms when, though the amount of displacement of the piezoelectric device is the same, the time of displacement in the direction in which the volume of the pump chamber is reduced is longer, and the pressure inside the pump chamber is not increased sufficiently (W1 is a waveform of the displacement of the diaphragm when the pump has been operated, while W2 is a waveform of the pressure inside the pump chamber).

In the state of operation in FIG. 3, at a timing in which a pump chamber volume increasing step (not shown) is started, the pressure inside the pump chamber is equal to the load pressure $P_{fu}$. Even if the pressure inside the pump chamber is reduced by an increase in the volume of the pump chamber resulting from a decrease in the displacement of the diaphragm, in order to make the pressure inside the pump chamber less than the suction-side pressure, the diaphragm needs to be largely displaced, so that the performance of the pump is considerably reduced. In some cases, the pressure inside the pump chamber does not become less than the suction-side pressure, so that a suction valve does not open. Therefore, in the outlet flow path, the volume of flow in the discharge direction and the volume of back flow in the direction of the inside of the pump chamber become the same, so that the pump does not function as a pump.

Accordingly, the principle of operation of the pump having the structure of the invention is different from that of a related positive displacement pump which discharges a discharge fluid volume (more precisely, an amount equal to displacement volume×volume efficiency) by displacing a diaphragm by one period of pumping operation. Consequently, a distinctive feature of the pump of the present invention is that the displacement velocity in the pump chamber volume reducing step of the diaphragm 5 and the timing between changes in the pressure inside the pump and the pump chamber volume increasing step greatly affect the pump output.

Thus, first, a method of moving the diaphragm to cause the pump to function satisfactorily as a pump is described below.

As mentioned above, the pressure inside the pump chamber 3 changes in accordance with the relationship between a change in the volume of the fluid inside the pump chamber 3 and the rate of compression of the fluid. Therefore, when the discharge fluid volume is larger than the sum of the displacement volume and the suction fluid volume, even if the volume of the pump chamber 3 is decreasing, the pressure inside the pump chamber may decrease. In addition, by the displacement velocity in the pump chamber volume reducing step of the diaphragm 5, the amount of reduction in the pressure inside the pump chamber changes.

Accordingly, during a pump chamber volume reducing step or when a movable wall is stopped at the reached-displacement-position, driving the diaphragm 5 as a result of selecting the displacement velocity so that the pressure inside the pump chamber 3 becomes equal to or less than the general suction-side pressure makes it possible to reduce the pressure inside the pump chamber 3 to a value equal to or less than the suction-side pressure without displacing the diaphragm 5 in the direction in which the volume of the pump chamber increases. Under this condition, when the diaphragm is driven with a high displacement velocity, even during the time in which the diaphragm is moved in the direction in which the volume of the pump chamber is reduced and is stopped at the reached-displacement-position, the pressure inside the pump chamber 3 is maintained at a value less than the suction-side pressure for a while, so that fluid can flow from the inlet flow path.

In addition, when the pump chamber volume increasing step is performed during the time in which the pressure inside the pump chamber 3 is equal to or less than the suction-side pressure, almost all of the displacement of the diaphragm 5 can be used to cause fluid to flow into the pump chamber while maintaining the pressure inside the pump at a value less than the suction-side pressure, so that, by effectively making use of the limited amount of displacement of the actuator, the flow rate can be increased.

The diaphragm 5 may be driven so that the maximum value of the pressure inside the pump chamber 3 becomes equal to or greater than twice the load pressure minus the suction-side pressure. W2 shown in FIG. 3 indicates a pressure state that barely satisfies this condition.

When this is done, by a natural vibration of the fluid inside the outlet flow path and the pump chamber, the amplitude of the pressure inside the pump is a value substantially equivalent to a difference between the load pressure and the suction-side pressure, and the fluid vibrates with the load pressure as a central value, so that, by pressure vibration alone, the pressure inside the pump can be reduced to a value equal to or less than a value close to the suction-side pressure.

In particular, by driving the diaphragm 5 so that the maximum pressure inside the pump chamber 3 becomes a value equal to or greater than twice the load pressure, the pressure inside the pump chamber 3 can be reliably reduced to a value less than the suction-side pressure, so that the pressure inside the pump chamber 3 is maintained less than the suction-side pressure for a while, thereby making it possible for the fluid to flow from the inlet flow path.

Depending upon the displacement velocity in the pump chamber volume reducing step of the diaphragm 5, by only moving the diaphragm in the direction in which the volume of the pump chamber is reduced and stopping the diaphragm at the reached-displacement-position, the maximum pressure inside the pump chamber 3 becomes equal to or greater than twice the load pressure, so that, it is possible to cause fluid to flow into the pump chamber from the inlet flow path.

When the pump chamber volume increasing step is performed during the time in which the pressure inside the pump chamber 3 is equal to or less than the suction-side pressure, almost all of the displacement of the diaphragm 5 can be used to cause fluid to flow into the pump chamber while maintaining the pressure inside the pump at a value less than the suction-side pressure. Therefore, the limited amount of displacement of the actuator can be effectively used, so that the flow rate can be increased.

The diaphragm 5 may be driven so that the time during which the pressure inside the pump is less than the suction-side pressure is equal to or greater than 60% of one period of movement of the diaphragm. Driving operation in FIG. 2 is an example satisfying this condition. When the diaphragm 5 is driven under this condition, it is possible to increase suction time of the pump, and thus to suck a larger amount of fluid into the pump chamber from the inlet flow path.

Depending upon the displacement velocity in the pump chamber volume reducing step of the diaphragm 5, by only moving the diaphragm in the direction in which the volume of the pump chamber is reduced and stopping the diaphragm at the reached-displacement-position, the time during which the pressure inside the pump is less than the suction-side pressure is equal to or greater than 60% of one period of movement of the diaphragm. Therefore, during this time, it is possible to suck the fluid into the pump chamber from the inlet flow path.

At this time, when the pump chamber volume increasing step is performed during the time in which the pressure inside the pump chamber 3 is equal to or less than the suction-side pressure, almost all of the displacement of the diaphragm 5 can be used to cause fluid to flow into the pump chamber while maintaining the pressure inside the pump at a value less than the suction-side pressure, so that the suction time can be made longer and the limited amount of displacement of the actuator is effectively used. Therefore, the flow rate can be increased.

Next, a method of moving the diaphragm to address or overcome a different problem is described below.

When the inertance definitional equation is time integrated:

[Formula 3] (3)

$$\int \Delta P dt = LQ|_{t0}^{t1}$$

Since the inertance is constant, in a duct, the larger the integral value of the difference between the pressures at both ends of the duct, the larger the amount of change in the fluid volume velocity Q of the fluid inside the duct during this time. At the outlet fluid path 2, the larger the integral value of the difference between the pressure inside the pump chamber 3 and the load pressure $P_{fit}$, the faster the flow of the fluid inside the outlet flow path 2 towards the discharge direction (that is, the larger the momentum of the flowing fluid). Until the momentum of the fluid is reduced, a large amount of fluid can flow into the pump chamber 3 from the inlet flow path 1. In other words, for the outlet flow path 2, making the value on the left side of Formula (3) large produces the effect of increasing discharge flow rate (=suction flow rate) of the pump per pumping cycle. When the displacement velocity in the pump chamber volume reducing step of the diaphragm is increased, the value on the left side of Formula (3) tends to increase.

Figure 4:
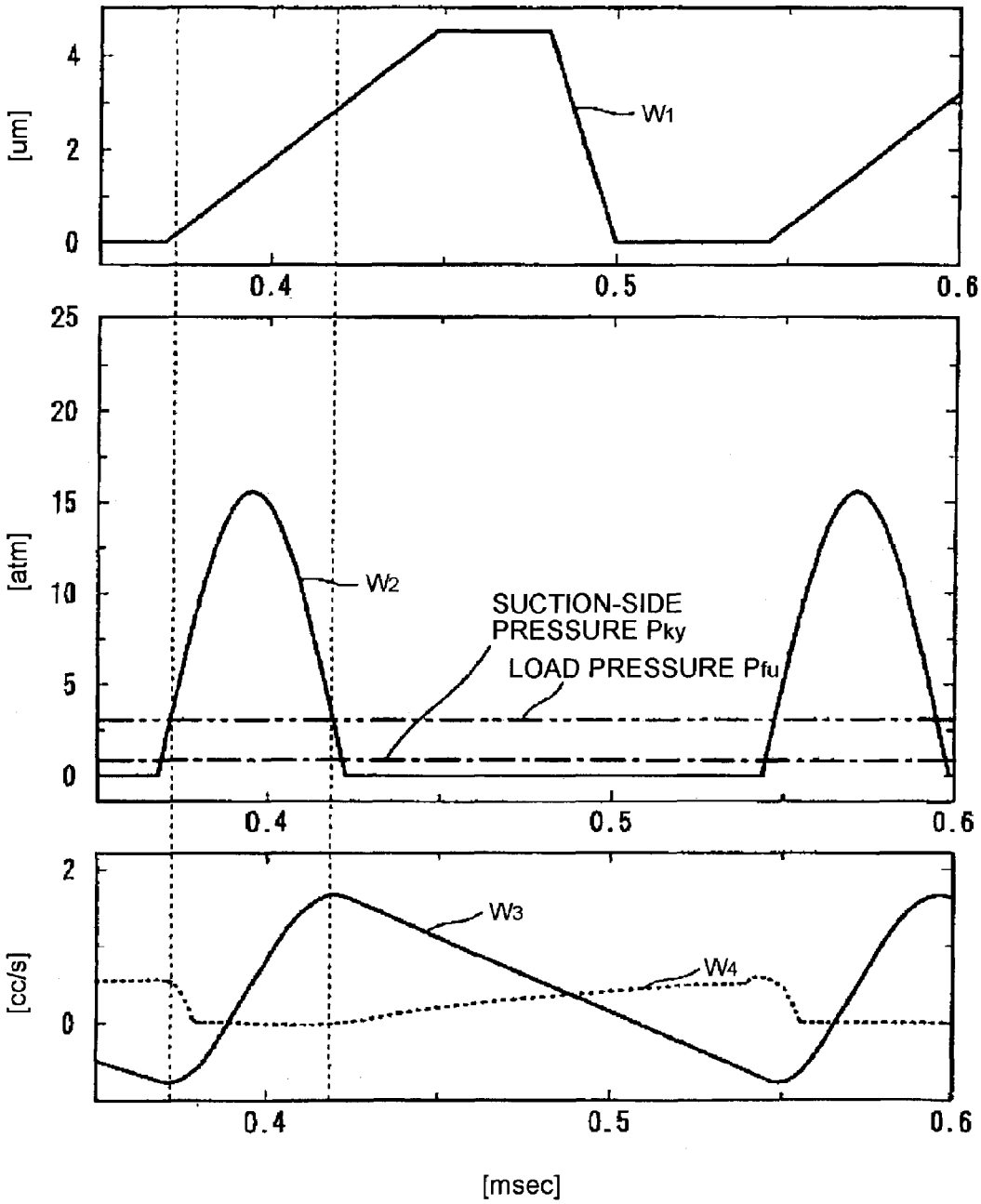
FIG. 4 shows graphs of state quantities when a diaphragm is displaced in the direction in which the pump chamber is compressed even subsequent to a reduction in the pressure inside the pump chamber to a value less than a load pressure by the operation of the pump of the first exemplary embodiment.

FIG. 4 illustrates waveforms when the diaphragm 5 is displaced towards the direction in which the pump chamber 3 is compressed subsequent to reduction of the pressure inside the pump chamber 3 to a value less than the load pressure $P_{fit}$, In this case, unlike the pump based on FIG. 3, the pump functions as a pump, but is subject to the following problems. That is, the displacement of the diaphragm 5 subsequent to reduction of the pressure inside the pump chamber 3 to a value less than the load pressure $P_{fit}$ does not contribute to increasing the pressure inside the pump, so that it does not have the effect of increasing the value on the left side of Formula (3). The pump output does not increase either. On the other hand, since energy is consumed when the piezoelectric device 6 is displaced, input to the pump is increased, so that pump efficiency is reduced.

Next, a description of the displacement velocity in the pump chamber volume reducing step of the diaphragm 5 required to address or solve such a problem is provided.

As illustrated in FIG. 3, since pressure vibration in the pump chamber 3 occurs at the natural vibration period of the fluid inside the outlet flow path 2 and the pump chamber 3 with the load pressure $P_{fit}$ as a central value, the period during which the pressure inside the pump chamber 3 is equal to or greater than the load pressure $P_{fit}$ is approximately half the natural vibration period of the fluid inside the outlet flow path 2 and the pump chamber 3.

If the displacement velocity in the pump chamber volume reducing step of the diaphragm 5 is equal to or greater than the displacement velocity at which the diaphragm reaches the reached-displacement-position in ½ of a natural vibration period T, the displacement amount of the diaphragm 5 contributes to increasing the value on the left side of Formula (3) without being uselessly used, so that the pump output can be increased.

The diaphragm 5 may be displaced to the displacement velocity which changes with time, in which case the diaphragm 5 is not displaced at a constant displacement velocity in the direction in which the volume of the pump chamber is reduced as shown in FIGS. 2 and 4. When an average displacement velocity in at least a half or more than half of the whole step of the diaphragm 5 in the direction in which the volume of the pump chamber is reduced is determined, and the average displacement velocity is set equal to or greater than the displacement velocity at which the diaphragm 5 reaches the reached-displacement-position in ½ of the natural vibration period T, the displacement amount of the diaphragm 5 contributes to increasing the value on the left side of Formula (3) virtually without being uselessly used, so that the pump output can be increased.

Figure 5:
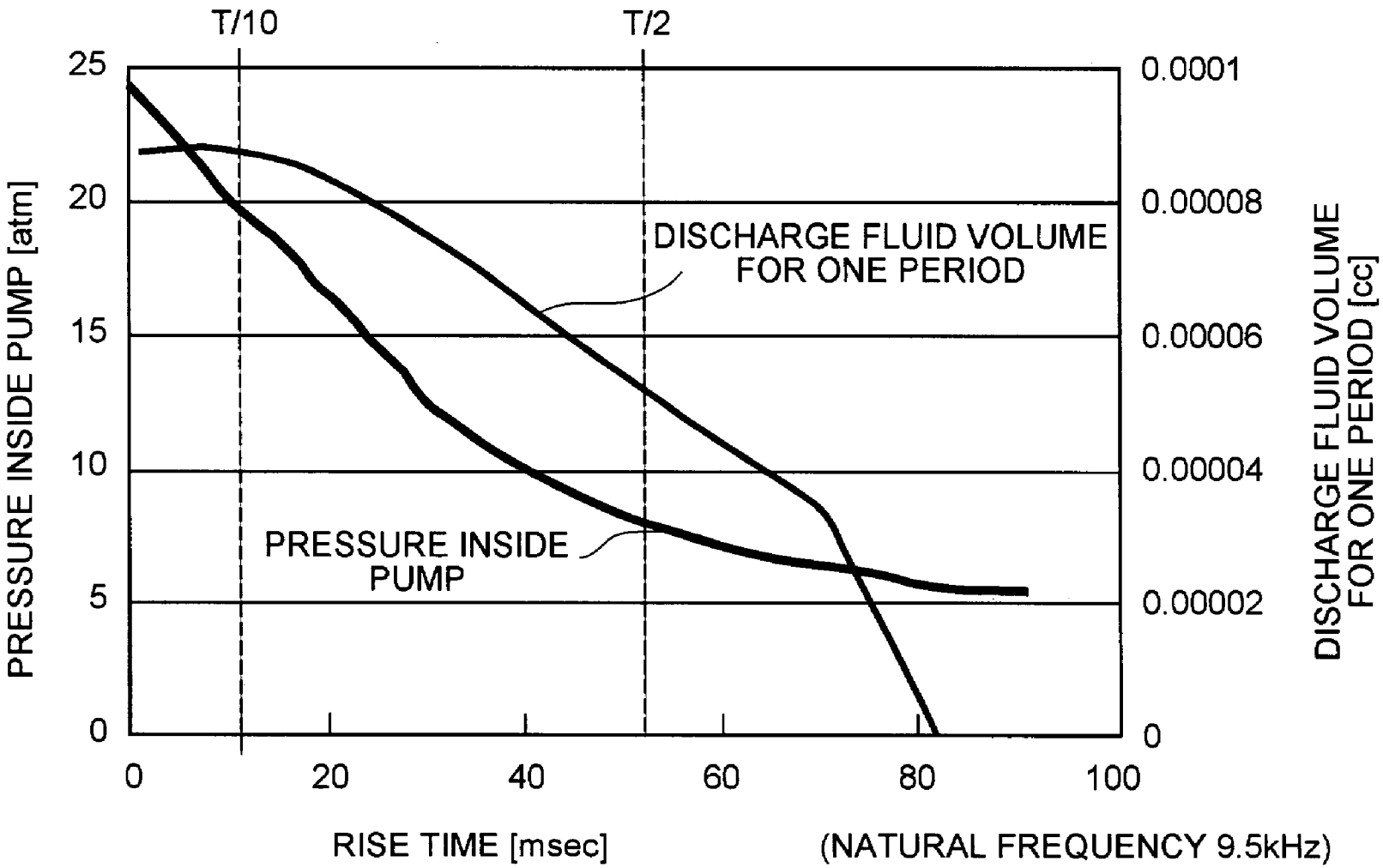
FIG. 5 shows a graph of the relationship between discharge fluid volume and the time (rise time) until the diaphragm reaches the reached-displacement-position in the pump of the first exemplary embodiment of the present invention.

FIG. 5 illustrates a graph showing the relationship between the time taken for the diaphragm 5 to reach the reached-displacement-position and the discharge fluid volume for one period, with the reached-displacement-position of the diaphragm 5 being the same. In FIG. 5, the natural vibration period of the fluid in the pump chamber 3 and the outlet flow path 2 is represented by T (in the graph, the natural frequency is 1/T=9.5 kHz). As shown in FIG. 5, when the time taken for the diaphragm 5 to be displaced in the direction in which the volume of the pump chamber 3 is reduced is too short, the pressure inside the pump chamber 3 is increased too much even though the discharge fluid volume for one period does not increase. As a result, problems arise in the durability of the diaphragm 5 and that of the check valve 4 defining the pump chamber 3. When the average displacement velocity in the pump chamber volume reducing step of the diaphragm 5 becomes less than the displacement velocity at which the diaphragm reaches the reached-displacement-position in a time less than 1/10 of the natural vibration period T, problems arise in the durability of the check valve 4 and that of the diaphragm 5.

By controlling the driving of the piezoelectric device 6 as in the first exemplary embodiment, it is possible to increase durability of the pump, and to effectively use the limited amount of displacement of the diaphragm 5 to increase flow rate. Therefore, it is possible to provide a small, light, high-output pump making sufficient use of the performance of the piezoelectric device 6, and a pump which can operate under a high load pressure and which has good drive efficiency as a result of increasing the discharge fluid volume per period.

When half of the natural vibration period T at the outlet flow path 2 and the pump chamber 3 elapses, the pressure inside of the pump chamber 3 becomes less than the load pressure. Therefore, if the diaphragm 5 is displaced in the direction in which the volume of the pump chamber 3 is increased subsequent to a time period T/2 from the start of the movement of the movable wall in the direction in which the volume of the pump chamber is reduced, the value on the left side of Formula (3) does not need to be reduced. In other words, the diaphragm can return to its state prior to displacement without reducing the discharge flow rate of the pump.

Second to fifth exemplary embodiments described below are exemplary embodiments to increase discharge fluid volume for one period by controlling movement of the diaphragm 5 in the direction in which the volume of the pump chamber 3 is reduced.

Figure 6:
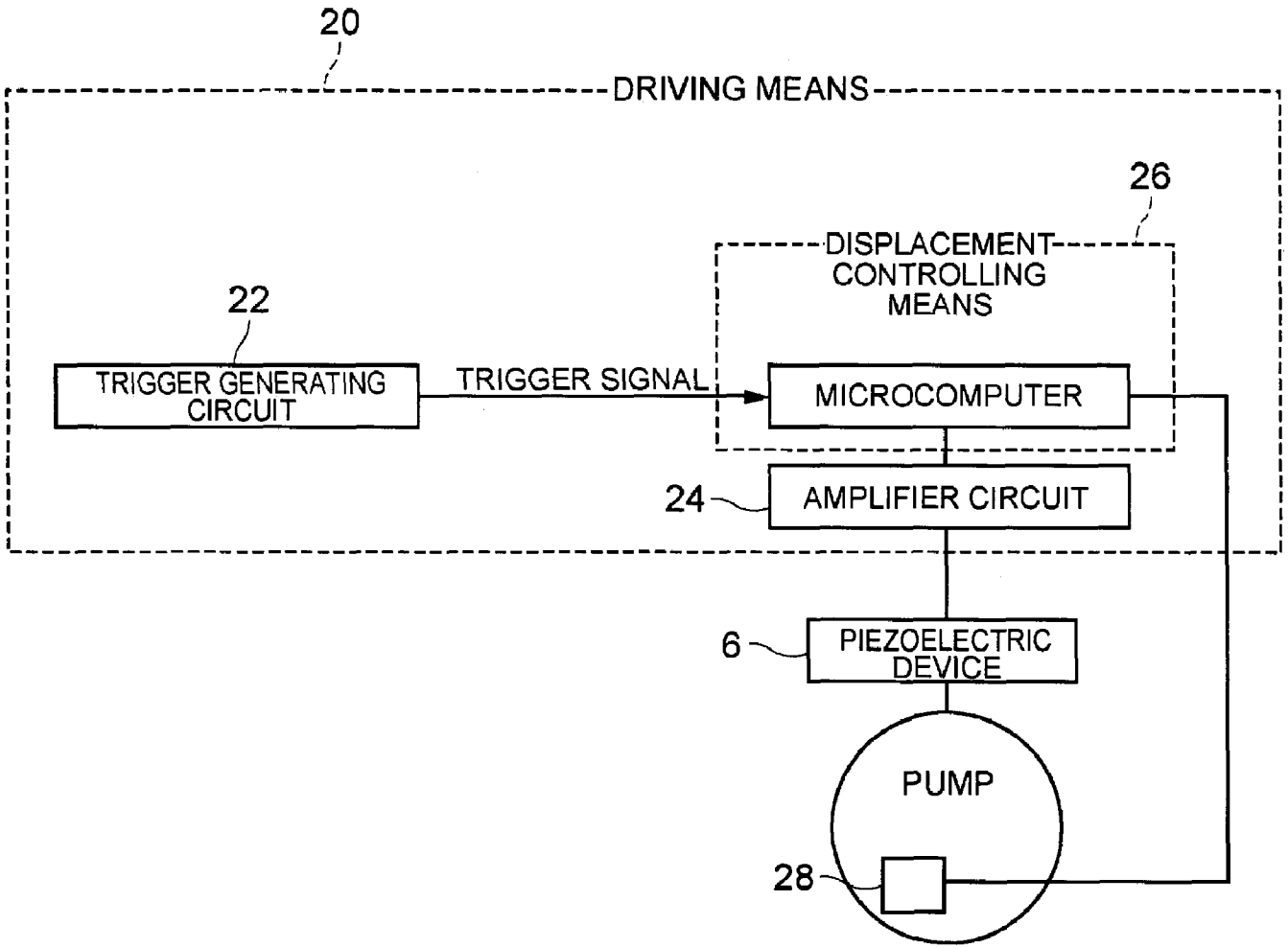
FIG. 6 is a schematic of driving device in a second exemplary embodiment of the present invention.

FIG. 6 illustrates the second exemplary embodiment and is a schematic of a driving device 20 to control driving of a piezoelectric device 6.

The driving device 20 includes a trigger generating circuit 22 to generate a trigger signal, a voltage amplifier circuit 24, and a displacement controlling device 26.

The trigger generating circuit 22 is a circuit to generate a trigger signal at a certain fixed period. The voltage amplifier circuit 24 amplifies electric power of an input signal to a predetermined electric power required to drive the piezoelectric device 6 and supplies the amplified electric power to the piezoelectric device 6.

The displacement controlling device 26 outputs a voltage waveform for one period when it receives a trigger signal. The displacement controlling device 26 controls a displacement velocity by varying a displacement time with a displacement position reached by the diaphragm 5 kept the same, based on a detection value from a pressure sensor (a pump pressure detecting device) 28 disposed in the pump including an outlet fluid path 2 and a pump chamber 3. The displacement controlling device 26 includes a microcomputer incorporating an I/O port and ROM.

Figure 7:
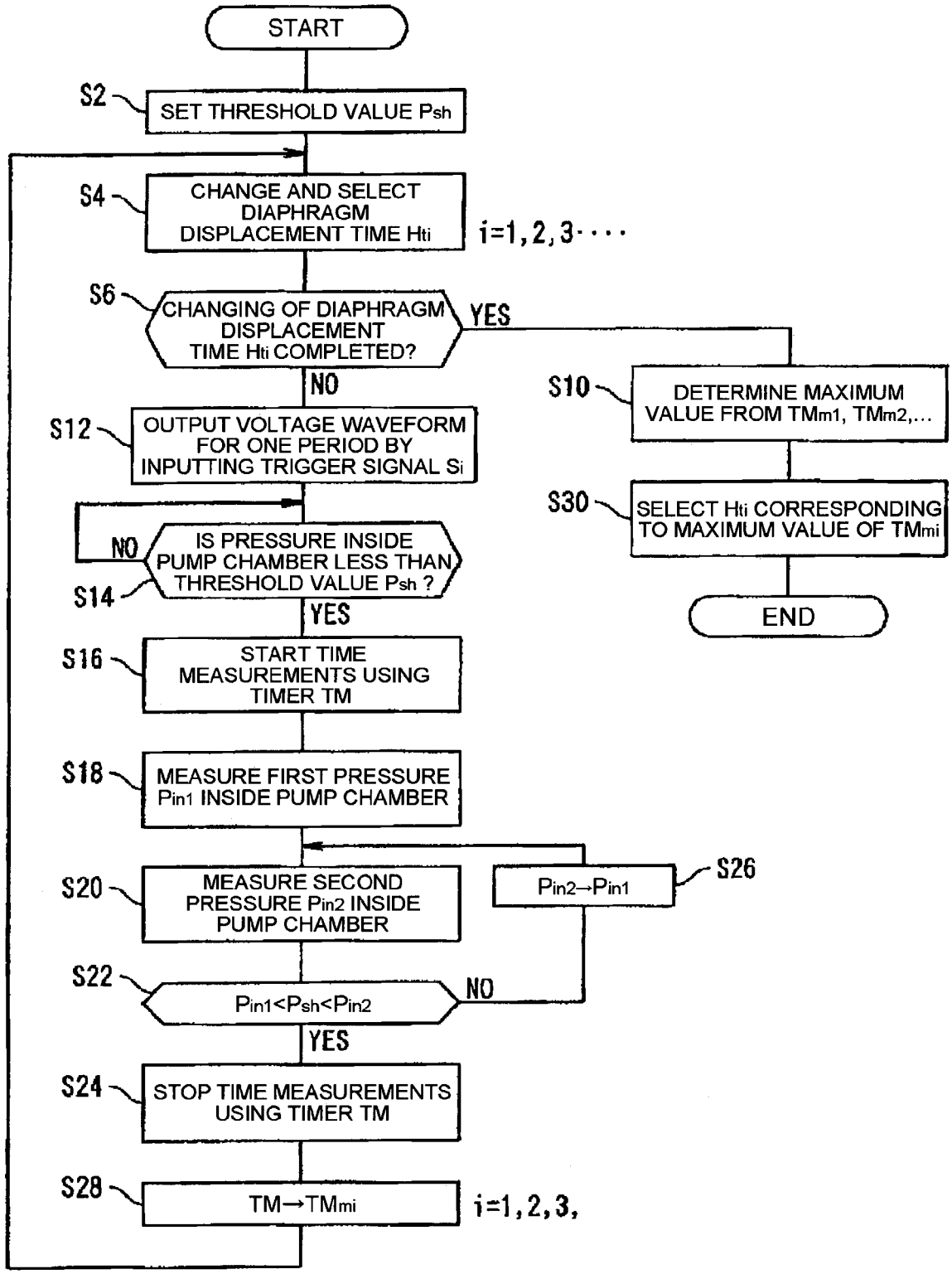
FIG. 7 is a flowchart of operational steps that are carried out by a driving device in the second exemplary embodiment.

FIG. 7 is a flowchart illustrating the operational steps of the displacement controlling device 26.

First, in Step S2, a threshold value $P_{sh}$ of a pressure is set. For the threshold value $P_{sh}$, a value equal to or greater than an output value when a suction-side pressure $P_{ky}$ is exerted upon the pressure sensor 28 is used. When this value is used, erroneous detection of the pressure due to a slight pressure increase when the pressure is low does not occur.

Next, the process proceeds to Step S4, in which a displacement time Ht1 is selected from a plurality of displacement times Hti (i=1, 2, 3, . . . ) of the diaphragm 5. From the next time and onwards, other displacement times Hti are selected.

Next, the process proceeds to Step S6, in which a confirmation is made as to whether or not measurements of elapse times TMmi (described below) for all of the displacement times Hti of the diaphragm 5 have been completed. If they are not completed, the process proceeds to Step S12, whereas if they are completed, the process proceeds to Step S10.

Next, in Step S12, by input of a trigger signal Si, an output of a voltage waveform for one period to the piezoelectric device 6 is started. Here, it is desirable to confirm that the pressure inside the pump chamber is steady prior to outputting the trigger signal.

Next, the process proceeds to Step S14, in which a confirmation is made as to whether or not the pressure inside the pump has become less than the threshold value $P_{sh}$. If it has become less than the threshold value $P_{sh}$, the process proceeds to Step S16.

In Step S16, time measurements by a timer TM is started.

Next, the process proceeds to Step S18, in which a first pressure Pin1 in the pump chamber 3 is measured by the pressure sensor 28.

Next, the process proceeds to Step S20, in which a second pressure Pin 2 in the pump chamber 3 is measured by the pressure sensor 28.

Next, the process proceeds to Step S22, in which a confirmation is made as to whether or not the relationship between the first pressure Pin1 in the pump chamber 3 and the second pressure Pin2 in the pump chamber 3 is Pin1<Psh<Pin2. If the relationship is Pin1<Psh<Pin2, the process proceeds to Step S24, whereas, if the relationship is not Pin1<Psh<Pin2, the process proceeds to Step S26.

In Step S26, the second pressure Pin2 in the pump chamber 3 is used as the first pressure Pin1 in the pump chamber 3, and the process returns to Step S20.

In Step S24, the time measurements by the timer TM is stopped.

Next, the process proceeds to Step S28, in which the values measured by the timer TM are stored as the elapse times TMmi (i=1, 2, 3, . . . ). Then, the process returns to Step S4.

In Step S10 to which the process proceeds when, in Step S6, the measurements of the elapse times TMmi for all of the displacement times Hti of the diaphragm 5 are completed, the maximum value among the elapse times TMm1, TMm2, TMm3, . . . , which have been stored up to now, is determined.

Next, the process proceeds to Step S30, in which the displacement time Hti of the diaphragm 5 that corresponds to the predetermined maximum elapse time TMmi is selected. Then, the process ends.

The driving device 20 controls the driving of the piezoelectric device 6 so that the diaphragm 5 is displaced in the selected displacement time Hti.

By carrying out the operations of the displacement controlling device 26 shown in FIG. 7, it is possible to set the displacement time of the diaphragm 5 when it is displaced in the direction in which the volume of the pump chamber 3 is reduced so that the time that elapses until the pressure inside the pump chamber 3 exceeds the previously set threshold value $P_{sh}$ is the longest. Due to the following reasons, it is possible to provide a pump having good drive efficiency by increasing discharge fluid volume per pumping period.

Figure 8:
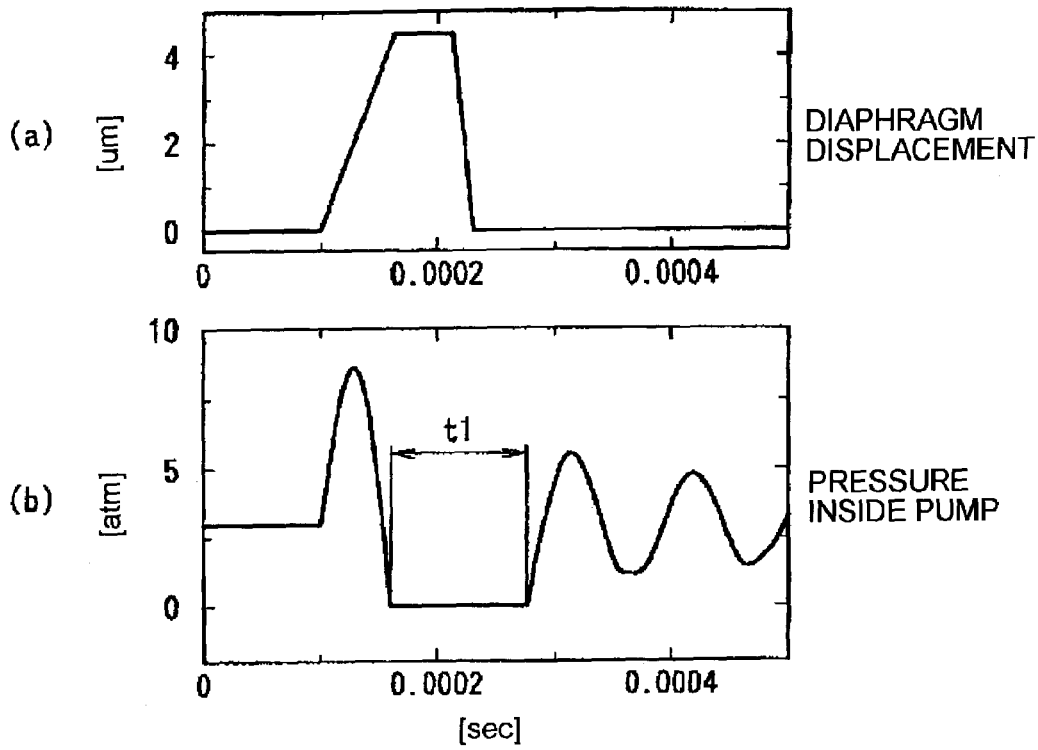
FIGS. 8(*a*) and 8(*b*) each show a graph of a state in which predetermined single pulses are input to a diaphragm in the pump of the present invention.

The reasons are provided using FIGS. 8(*a*) and 8(*b*) and 9(*a*) and 9(*b*). FIGS. 8(*a*) and 9(*a*) show the displacement of the diaphragm 5 resulting from applying different drive voltage waveforms in the form of single pulses to the piezoelectric device 6 of the pump of the exemplary embodiment, and FIGS. 8(*b*) and 9(*b*) show changes in the pressure inside the pump chamber 3 in accordance with the displacement.

As is clear from FIGS. 8(*a*) and 8(*b*) and 9(*a*) and 9(*b*), when the diaphragm 5 is displaced by single pulses, even if the diaphragm 5 is stationary, the pressure inside the pump chamber 3 is temporarily reduced to a value near absolute zero atmospheres, and, then, after passage of a certain time, is increased again.

Phenomena regarding the pressure inside the pump chamber 3 is described below. When a change in the fluid volume inside the pump chamber 3 is ΔV, the pressure inside the pump chamber 3 is determined by the equation ΔV=displacement volume by the diaphragm 5+suction fluid volume−discharge fluid volume, and the compressibility of the fluid. Therefore, even if the diaphragm 5 is made stationary, and the displacement volume is made zero, the pressure inside the pump chamber is changed by changes in the suction fluid volume and the discharge fluid volume. After the diaphragm 5 has been displaced by a displacement amount for one period by single pulses, the amount of increase in the suction fluid volume gradually becomes greater than the amount of increase in the discharge fluid volume, so that the pressure inside the pump chamber 3 gradually increases.

Figure 9:
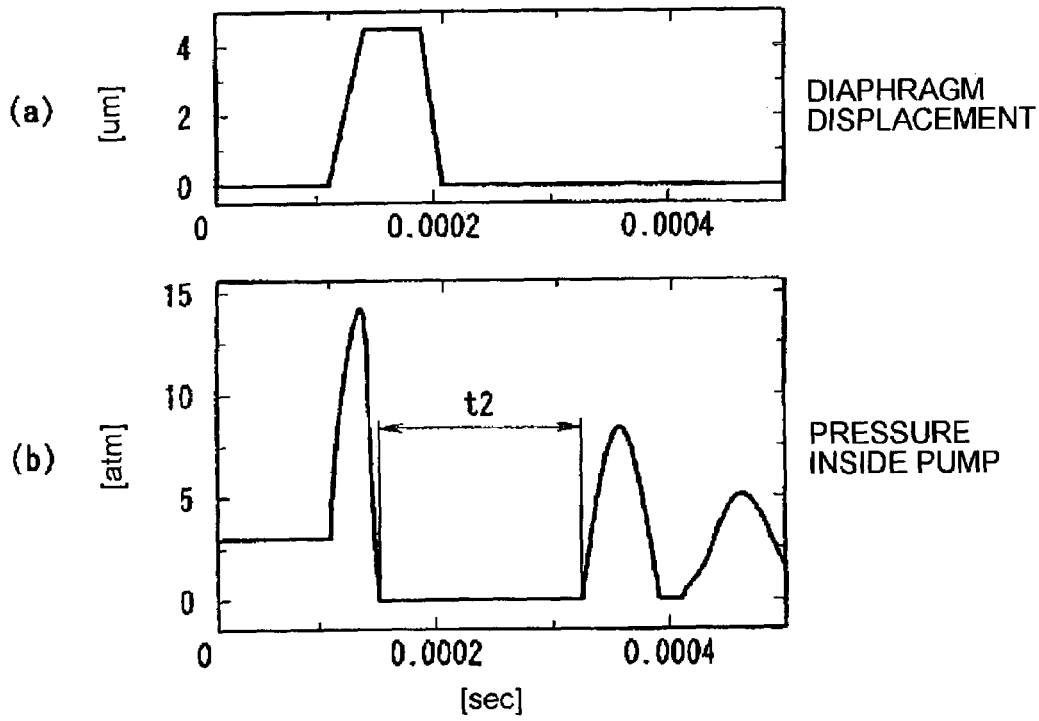
FIGS. 9(*a*) and 9(*b*) each show a graph of a state in which predetermined single pulses that are different from those used in FIGS. 8(*a*) and 8(*b*) are input to the diaphragm in the pump of the present invention.

Since the inclination of the rising side of the waveform of the displacement of the diaphragm 5 shown in FIG. 9(*a*) is larger than the inclination of the rising side of the waveform of the displacement of the diaphragm 5 shown in FIG. 8(*a*), the displacement velocity of the diaphragm 5 is greater in FIG. 9(*a*) than in FIG. 8(*a*). In addition, the time taken for the pressure inside the pump chamber 3 to increase again is longer in FIG. 9(*b*) than in FIG. 8(*b*) (t1<t2). When aeration or cavitation occurs, the time t required for the pressure inside the pump chamber 3 to increase again becomes longer the larger the discharge fluid volume for one period. Therefore, when the time t is measured and the displacement time Ht (rise velocity) required for the diaphragm 5 to be displaced to the reached-displacement-position so that the time t becomes long is selected as appropriate, the discharge fluid volume for one period can be increased.

Although the pressure sensor 28 is used as a pump pressure detecting device, a strain gauge or a displacement sensor may be used to measure the amount of distortion of the diaphragm in order to calculate the pressure inside the pump chamber 3. A strain gage may also be used to measure deformation of the pump itself in order to calculate the pressure inside the pump chamber 3. Further, a strain gauge or a displacement sensor may be used to measure deformation of the pump chamber 3 caused by the pressure inside the pump chamber 3 with a passive valve at an inlet flow path 1 side being closed in order to calculate the pressure inside the pump chamber 3. To measure displacement of the piezoelectric device 6, a strain gauge may be mounted to the piezoelectric device 6 in order to calculate the pressure inside the pump chamber 3 from the voltage or electric charge applied to the piezoelectric device 6 (target displacement amount), a value (actual displacement amount) measured by the strain gage, and Young's modulus of the piezoelectric device 6. Since, in these methods, the devices do not need to be disposed inside the pump chamber 3, downsizing of the pump can be facilitated. Types of strain gauges which may be used are, for example, a type which detects the amount of distortion by a change in resistance, a type which detects the amount of distortion by a change in capacitance, and a type which detects the amount of distortion by a change in voltage.

When a device is provided to correct the displacement velocity of the diaphragm 5 when it is displaced in the direction in which the volume of the pump chamber 3 is reduced, it is possible to control the displacement velocity more quickly while providing the same advantages. Here, an elapse time for a certain displacement velocity and a correction amount added to the displacement velocity to make the elapse time an ideal maximum elapse time are previously determined by, for example, experiment, and the elapse time and the correction amount are mapped and held in ROM of the displacement controlling device. When the elapse time is measured, the correcting device refers to the map thereof to correct the displacement velocity.

Figure 10:
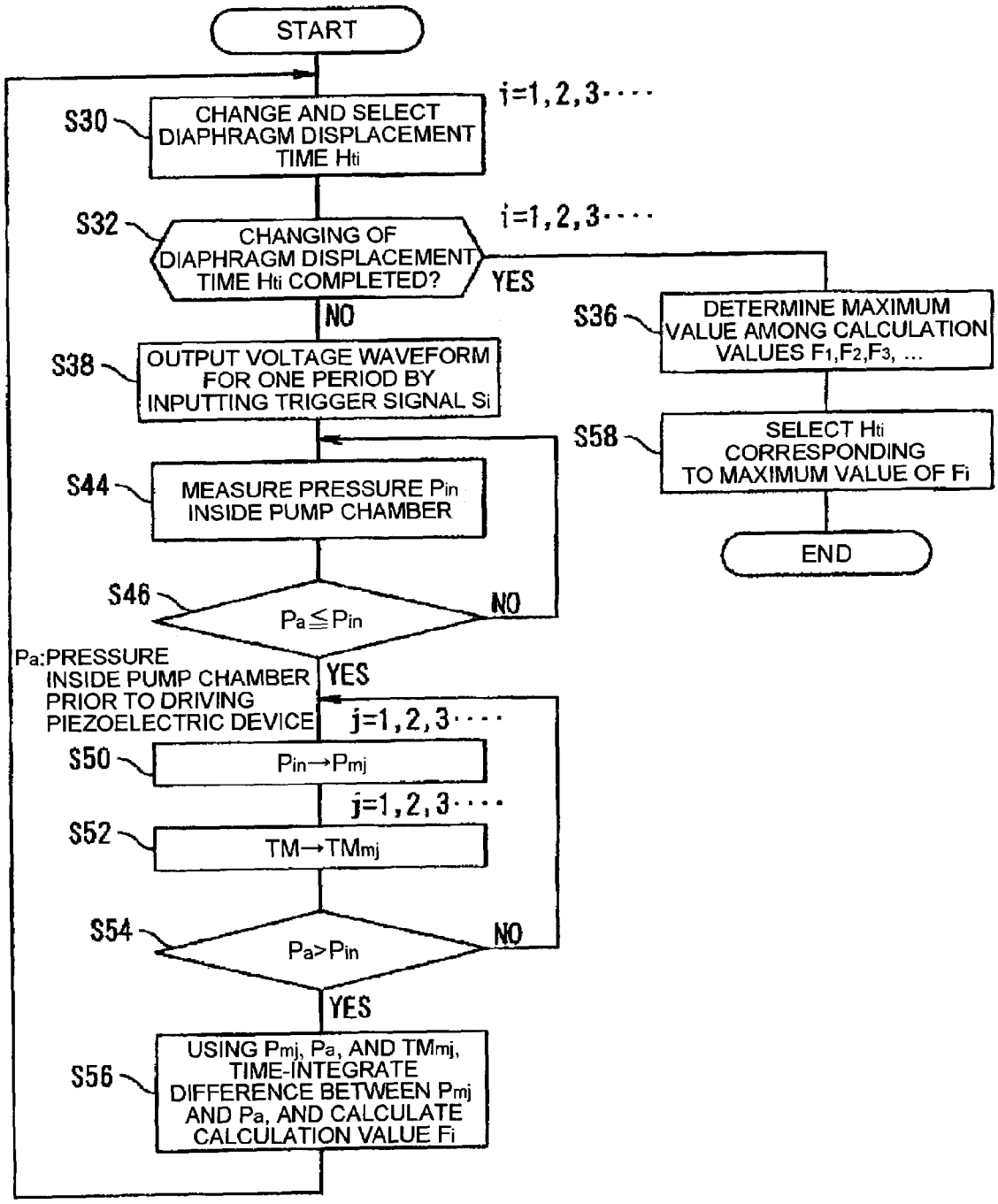
FIG. 10 is a flowchart of operational steps that are carried out by a driving device in a third exemplary embodiment of the present invention.

FIG. 10 illustrates the operational steps of a pump of the third exemplary embodiment of the present invention.

FIG. 10 is also a flowchart illustrating the operational steps of a displacement controlling device 26. The structure of the displacement controlling device 26 is the same as that shown in FIG. 6, so that a schematic of a driving device 20 is omitted.

First, in Step S30, a displacement time Ht1 is selected from a plurality of displacement times Hti (i=1, 2, 3, . . . )

of a diaphragm 5. From the next time and onwards, other displacement times are selected from the displacement times Hti.

Next, the process proceeds to Step S32, in which a confirmation is made as to whether or not calculations of calculation values Fi (described later) for all of the displacement times Hti of the diaphragm 5 have been completed. If they are not completed, the process proceeds to Step S38, whereas if they are completed, the process proceeds to Step S36.

Next, in Step S38, by input of a trigger signal Si, an output of a voltage waveform for one period to a piezoelectric device 6 is started.

Next, the process proceeds to Step S44, in which a pressure $P_{in}$ in a pump chamber 3 is measured by a pressure sensor 28.

Next, the process proceeds to Step S46, in which a confirmation is made as to whether or not the relationship between a standard value (predetermined value) Pa and the pressure $P_{in}$ inside the pump chamber 3 is $Pa \leqq P_{in}$. The standard value Pa is the value of the pressure inside the pump chamber prior to driving the piezoelectric device 6. If the relationship is $Pa \leqq P_{in}$, the process proceeds to Step S50, whereas if it is not $Pa \leqq P_{in}$, the process returns to Step S44.

Next, in Step S50, the measured pressure $P_{in}$ in the pump chamber 3 is stored as a stored pressure value Pmj (j=1, 2, 3, . . . ; the j value is increased in increments every time this step is performed). In Step S52, the time when measuring the pressure is stored as TMmj (j=1, 2, 3, . . . ). Then, the process proceeds to Step S54.

In Step S54, the pressure $P_{in}$ inside the pump chamber is measured in order to confirm whether or not the relationship between the measured value and the standard value Pa is $Pa > P_{in}$. If the relationship is $Pa > P_{in}$, the process proceeds to Step S56, whereas, if it is not $Pa > P_{in}$, the process returns to Step S50.

In Step S56, the stored pressure value Pmj (j=1, 2, 3, . . . ), the standard value Pa, and the time TMmj (j=1, 2, 3, . . . ) are used in order to time-integrate the difference between the stored pressure value Pmj and the standard value Pa and to calculate the calculation value Fi.

In Step S36 to which the process proceeds when, in Step S32, the calculations of the calculation values Fi for all of the displacement times Hti of the diaphragm 5 have been completed, the maximum value among the calculation values F1, F2, F3, . . . , that have been stored up to this time is determined.

Next, the process proceeds to Step S58, in which the displacement time Hti of the diaphragm 5 corresponding to the maximum predetermined calculation value Fi is selected. Then, the process ends.

The driving device 20 controls the driving of the piezoelectric device 6 so that the diaphragm 5 is displaced in the selected displacement time Hti.

By carrying out the operations of the displacement controlling device 26 described above, the displacement time of the diaphragm 5 when it is displaced in the direction in which the volume of the pump chamber 3 is reduced can be set so that, when the value on the left side of Formula (3) is calculated, it becomes a maximum. Therefore, discharge fluid volume per pumping period is increased, so that a pump having good drive efficiency can be provided.

As in the exemplary embodiment, when the calculation value is obtained by time-integrating the difference between the pressure value Pi and the standard value Pa, the piezoelectric device 6 can be controlled with high precision. However, it is possible to obtain the calculation value, for example, by integrating the difference between a peak value of the pressure Pi inside the pump chamber 3 and the standard value Pa and the time during which the standard value Pa≦the pressure Pi.

In the pump of the present invention, since the outlet duct (downstream from the outlet flow path 2) connected to the outlet flow path 2 is opened to the pump chamber 3, the pressure inside the pump chamber 3 prior to driving the piezoelectric device 6 is equal to the load pressure $P_{fit}$.

Accordingly, instead of making the pressure inside the pump chamber prior to driving the piezoelectric device 6 the standard value Pa, it is possible to make the load pressure $P_{fit}$ the standard value (predetermined value) in order to carry out the operational steps of the displacement controlling device 26 in the third exemplary embodiment that is described using FIG. 10.

When the load pressure $P_{fit}$ is the standard value, if the load pressure $P_{fit}$ is previously known, it is desirable to use this value because this is simpler. In addition, it is desirable to provide a device to measure the load pressure $P_{fit}$ and to use the value measured by this measuring device because various load pressures $P_{fit}$ that cannot be previously estimated can be used. When the driving operation of the pump is temporarily stopped for a few waveforms of driving (for example, in the case where the pump is driven at a frequency of 2 kHz, the pump is driven for 2000 waveforms, is stopped for 10 waveforms of driving, and is driven again for 2000 waveforms), pressure vibration inside the pump chamber 3 is stopped during the time when the driving of the pump is stopped, so that, at this time, the pressure inside the pump chamber 3 is equal to the load pressure $P_{fit}$. Accordingly, it is desirable to use for the load pressure $P_{fit}$ a value provided by the pressure sensor 28 serving as a pump pressure detecting device at this time because various load pressures $P_{fit}$ can be used and because a new device to measure the load pressure does not need to be provided.

When a device is provided to correct the displacement velocity of the diaphragm 5 when it is displaced in the direction in which the volume of the pump chamber 3 is reduced, it is possible to control the displacement velocity more quickly while providing the same advantages. Here, a calculation value Fi for a certain displacement velocity and a correction amount added to the displacement velocity to make the calculation value Fi an ideal maximum calculation value Fmax are previously determined by, for example, experiment, and the calculation value Fi and the correction amount are mapped and held in ROM of the displacement controlling device. When the calculation value Fi is measured, the correcting device refers to the map thereof for correcting the displacement velocity.

Figure 11:
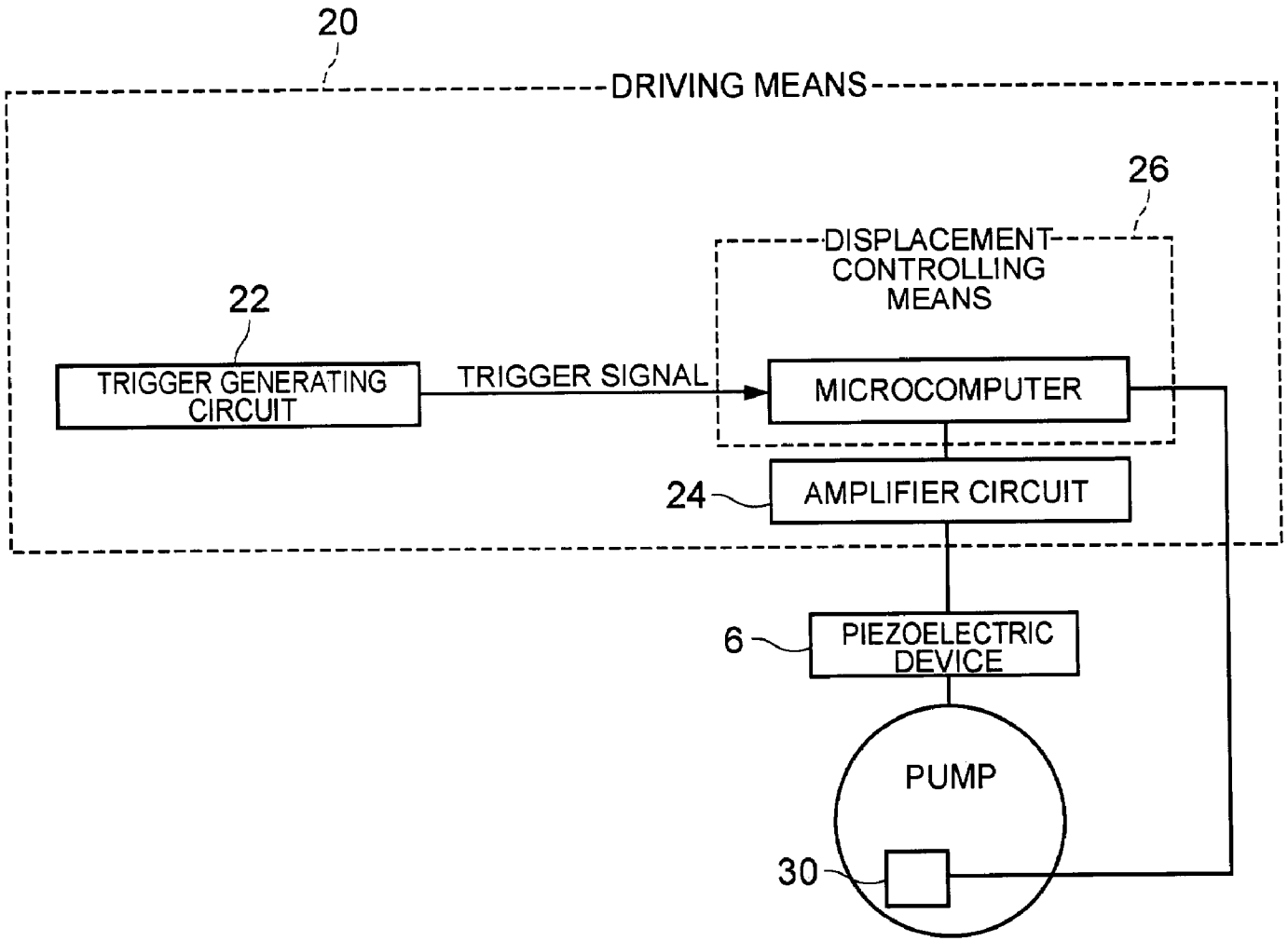
FIG. 11 is a schematic of a driving device in a fourth exemplary embodiment of the present invention.
Figure 12:
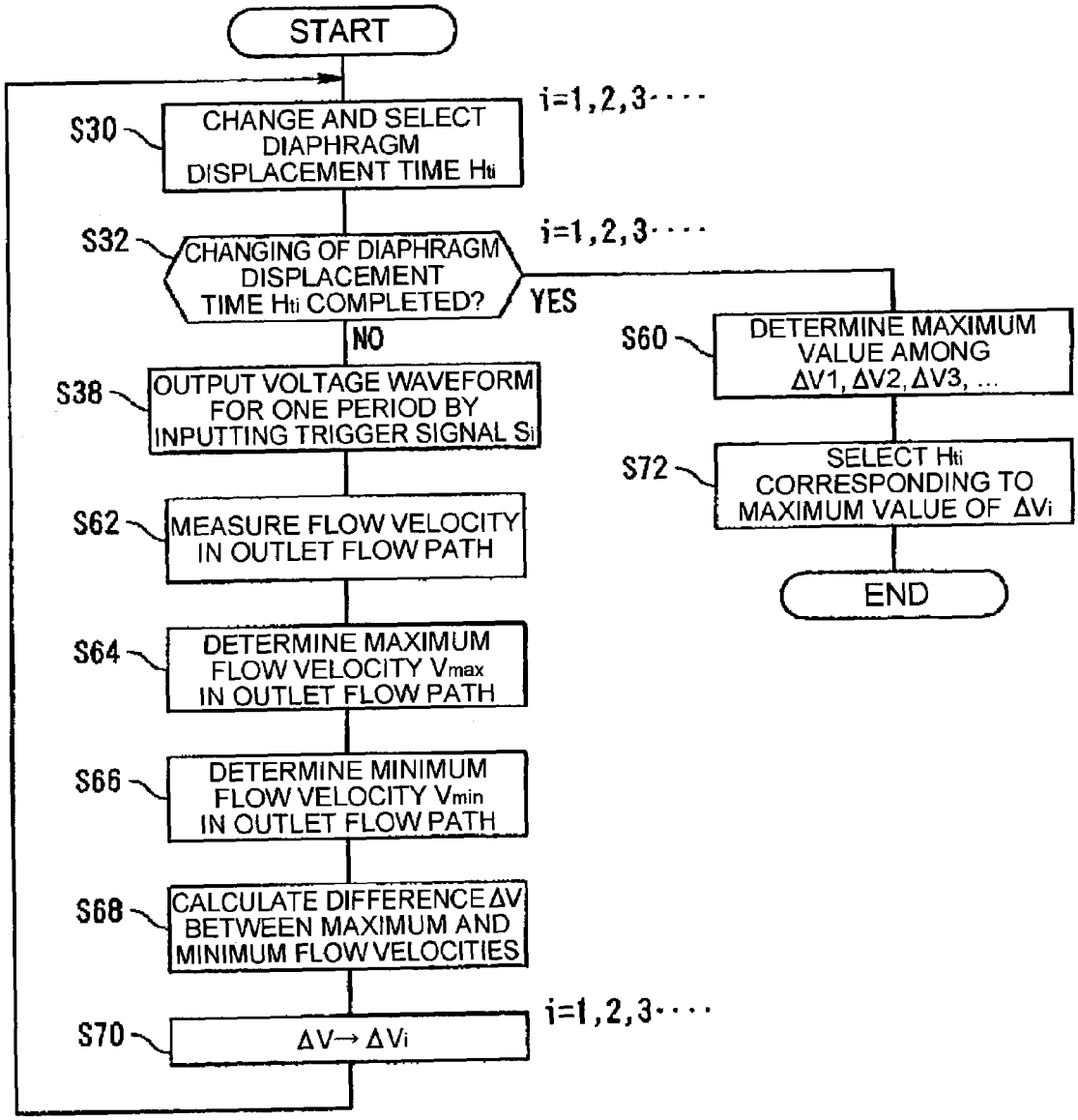
FIG. 12 is a flowchart of operational steps that are carried out by the driving device in the fourth exemplary embodiment of the present invention.

FIGS. 11 and 12 illustrate a fourth exemplary embodiment of the present invention.

FIG. 11 is a schematic of a driving device 20 to control driving of a piezoelectric device 6. A displacement controlling device 26 in the exemplary embodiment changes and determines a displacement time of a diaphragm 5 based on a detection value from a flow velocity sensor (a flow-velocity measuring device) 30 disposed at an outlet flow path 2 inside the pump.

FIG. 12 is a flowchart of the operational steps of the displacement controlling device 26 in the exemplary embodiment. The same steps as those in the flowchart of FIG. 10 illustrating the third exemplary embodiment are given the same reference numerals and are not described below. In Step S32, when calculations of flow velocity differences ΔV (described below) for all of the displacement times Hti of the diaphragm 5 are completed, the process proceeds to Step S60.

In the flowchart, when, in Step S38, by an input of a trigger signal Si, output of a voltage waveform for one period to the piezoelectric device 6 is started, the process proceeds to Step S62, in which flow velocities in the outlet flow path 2 is measured by the flow velocity sensor 30.

Next, the process proceeds to Step S64, in which a maximum flow velocity Vmax in the outlet flow path 2 is determined. Then, the process proceeds to Step S66, in which a minimum flow velocity Vmin in the outlet flow path 2 is determined.

Next, the process proceeds to Step S68, in which the difference ΔV between the maximum flow velocity Vmax and the minimum flow velocity Vmin is calculated.

Next, the process proceeds to Step S70, in which the flow velocity difference ΔV is stored as a stored flow velocity value ΔVi (i=1, 2, 3, . . . ). Then, the process returns to Step S30.

When the storage of the flow velocity differences ΔVi for all of the displacement times Hti of the diaphragm 5 is completed, the process proceeds to Step S60 in order to determine the maximum value among the velocity differences ΔV1, ΔV2, ΔV3, . . . , that have been stored up to this time.

Next, the process proceeds to Step S70, in which the displacement time Hti of the diaphragm 5 corresponding to the maximum predetermined flow velocity difference ΔVi is selected. Then, the process ends.

The driving device 20 controls the driving of the piezoelectric device 6 so that the diaphragm 5 is displaced in the selected displacement time Hti.

According to the exemplary embodiment, as illustrated in Formula (3) above, the larger the difference between the fluid volume velocities during integration, the larger the integral value of the difference between the pressure inside the pump chamber 3 and the load pressure. Therefore, discharge fluid volume per pumping period is increased, so that a pump having good drive efficiency can be provided.

When a device to correct the displacement velocity of the diaphragm 5 when it is displaced in the direction in which the volume of the pump chamber 3 is reduced is provided, it is possible to control the displacement velocity more quickly while providing the same advantages. Here, a flow velocity difference ΔV for a certain displacement velocity and a correction amount added to the displacement velocity for making the flow velocity difference ΔV an ideal maximum flow velocity difference ΔVmax are previously determined by, for example, experiment, and the flow velocity difference ΔV and the correction amount are mapped and held in ROM of the displacement controlling means. When the flow velocity difference ΔV which is the difference of a maximum flow velocity Vmax and a minimum flow velocity Vmin are measured, the correcting device refers to the map thereof to correct the displacement velocity.

The flow velocity sensor 30 in the exemplary embodiment may be, for example, an ultrasonic type, a type which measures the flow velocity by converting it into pressure, or a hot-wire type.

In the second to fourth exemplary embodiments, in order to simplify the circuit structure of the driving device, the maximum voltage applied to the piezoelectric device is made constant, and the displacement time of the pump chamber volume reducing step is changed with the reached-displacement-position of the diaphragm being the same in order to control the displacement velocity. However, the reached-displacement-position and the displacement time may both be changed in order to control the displacement velocity. Even if the distance of the reached-displacement-position is increased, by the controlling operation in the second to fourth exemplary embodiments, it is possible to make an increase in the pump output equal to or greater than an increase in a pump output that is in correspondence with an increase in the displacement volume of the diaphragm resulting from an increase in the distance of the reached-displacement-position that is reached by the diaphragm.

Figure 13:
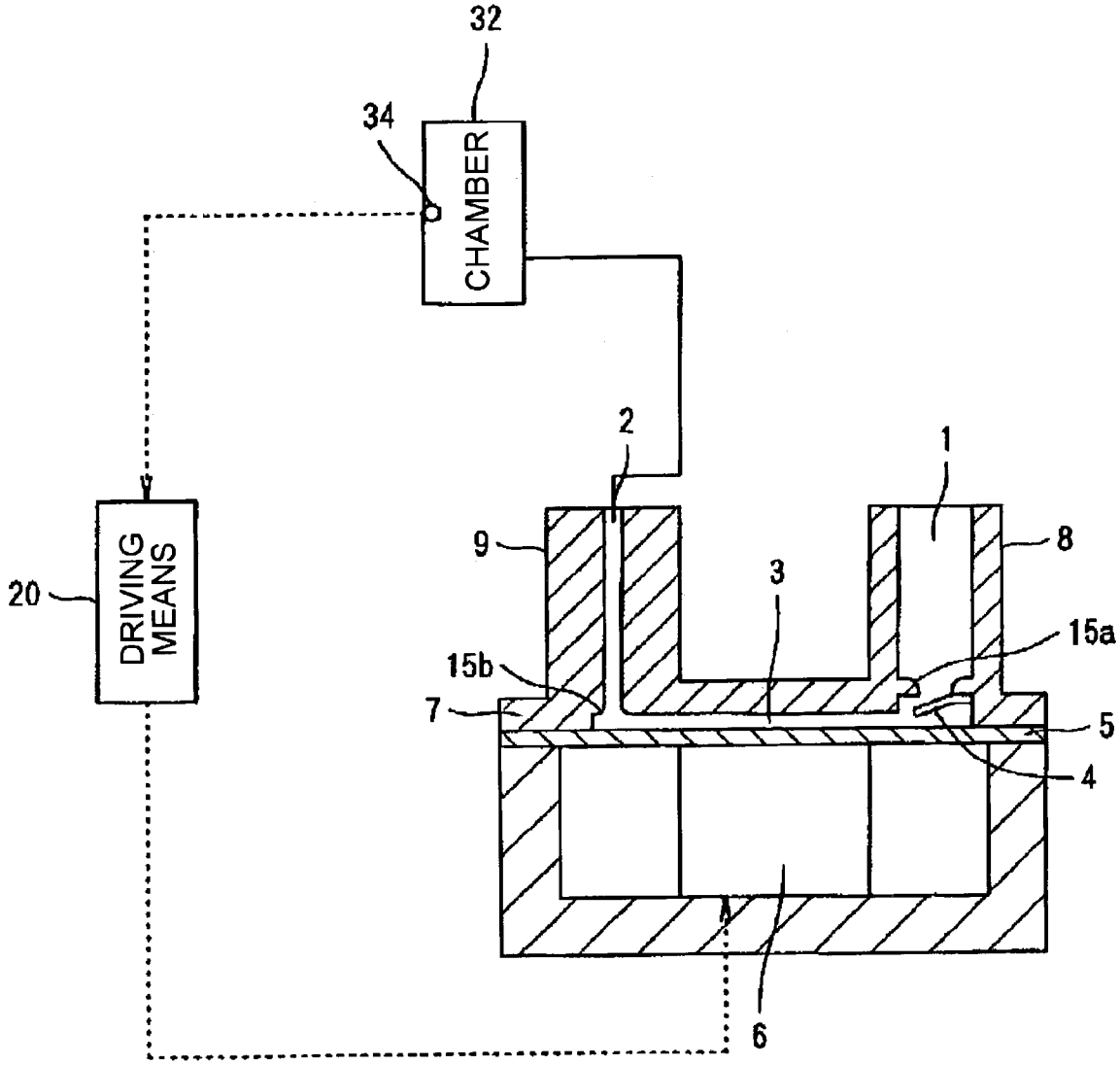
FIG. 13 is a schematic that shows a pump of a fifth exemplary embodiment of the present invention.

FIG. 13 illustrates a fifth exemplary embodiment.

In the exemplary embodiment, a chamber 32 which can hold fluid is connected to an outlet flow path 2 of the pump. The chamber 32 and a fluid surface sensor 34 disposed in the chamber 32 form a moving fluid volume measuring device. Information of detected fluid surface height is input to a driving device 20 from the fluid surface sensor 34.

When fluid is ejected from the outlet flow path 2 of the pump, the driving device 20 calculates discharge fluid volume per period of the diaphragm 5 by measuring discharge time and fluid surface height. The displacement velocity of the diaphragm 5 when it is displaced in the direction in which the volume of the pump chamber 3 is reduced is appropriately set so that the discharge fluid volume becomes a maximum. Therefore, the discharge fluid volume per pumping period is increased, so that a pump having good drive efficiency can be provided.

When a pulse absorbing buffer (not shown) is disposed at either an inlet flow path 1 or an outlet flow path 2, the amount of displacement of a film of the buffer is measured and the measured value is output to the driving device 20, and the displacement velocity of the diaphragm 5 when it is displaced in the direction in which the volume of the pump chamber 3 is reduced is set so that the amount of displacement of the buffer film becomes a maximum. Therefore, the discharge fluid volume per pumping period can be increased. This is because the larger the discharge fluid volume, the larger the volume of fluid that is absorbed/discharged by the buffer, so that the buffer film vibrates with a large displacement.

The process in the second to fifth exemplary embodiments may be carried out every time the driving of the pump is started, or at a suitable timing during the driving of the pump.

Figure 14:
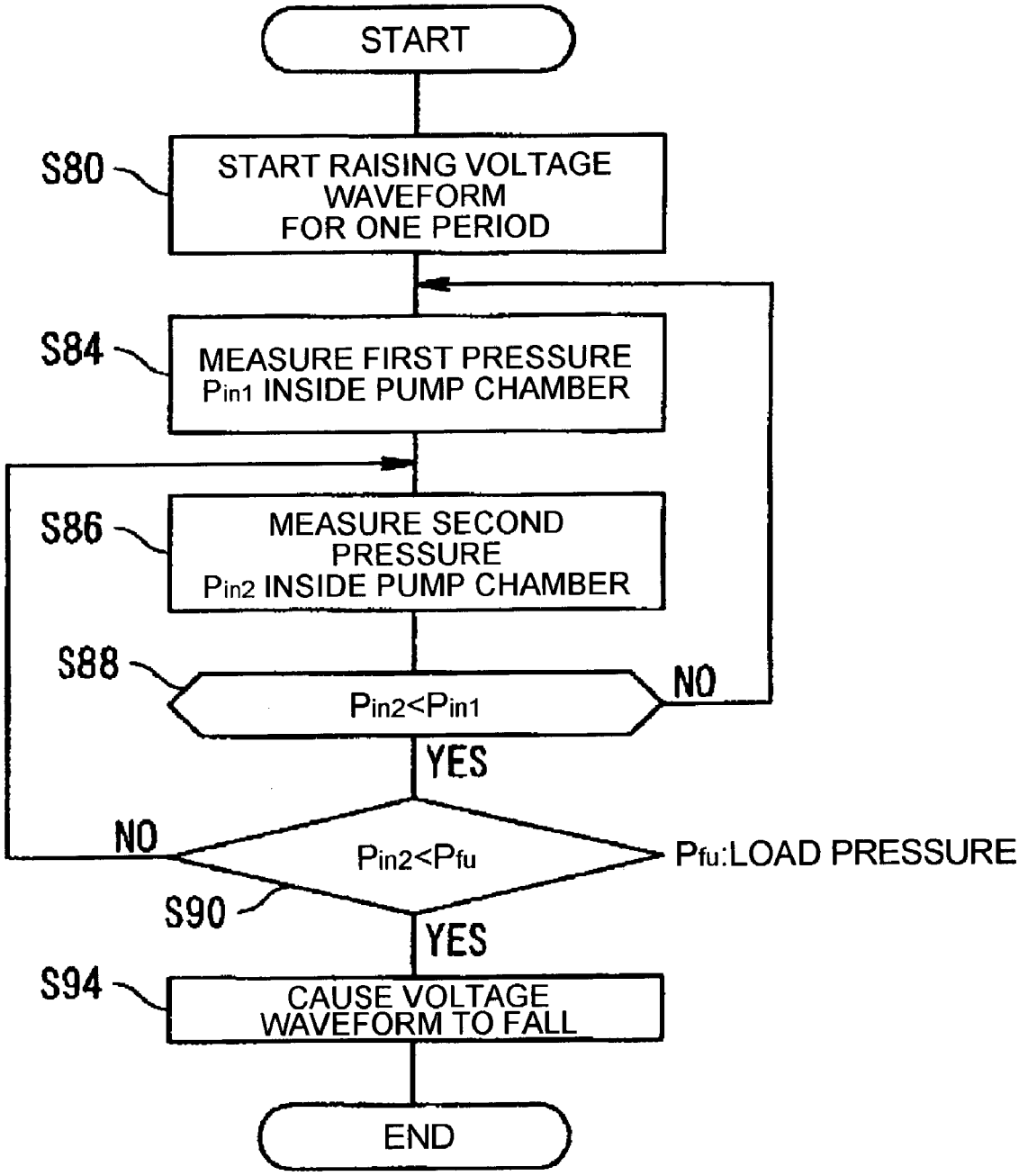
FIG. 14 is a flowchart of operational steps that are carried out by a driving device in a sixth exemplary embodiment of the present invention.

FIG. 14 illustrates a sixth exemplary embodiment.

The structure of a driving device in the exemplary embodiment is the same as that of the driving device in the second exemplary embodiment shown in FIG. 6. FIG. 14 is a flowchart of the operational steps carried out by a displacement controlling device 26 to increase discharge fluid volume per period by controlling a fall timing when a diaphragm 5 is displaced in the direction in which the volume of a pump chamber 3 is increased.

First, in Step S80, by an input of a trigger signal S, application of a voltage waveform for one period is started.

Next, the process proceeds to Step S84, in which a first pressure Pin1 in the pump chamber 3 is measured by a pressure sensor 28.

Next, the process proceeds to Step S86, in which a second pressure Pin2 inside the pump chamber 3 is measured by the pressure sensor 28.

Next, the process proceeds to Step S88, in which a confirmation is made as to whether or not the relationship between the first pressure Pin1 inside the pump chamber 3 and the second pressure Pin2 inside the pump chamber 3 is Pin2<Pin1. If it is Pin2<Pin1, the process proceeds to Step S90, whereas, if it is not Pin2<Pin1 , the process returns to Step S84.

In Step S90, a confirmation is made as to whether or not the relationship between the second pressure Pin2 inside the pump chamber 3 and a load pressure $P_{fu}$ is Pin2<$P_{fu}$. If the relationship is Pin2<$P_{fu}$, the process proceeds to Step S94, whereas, if it is not Pin2<$P_{fu}$, the process returns to Step S86.

In Step S94, the voltage of the voltage waveform starts to fall. Then, the process ends.

By the process in the exemplary embodiment, a fall timing where the diaphragm 5 is displaced in the direction in which the volume of the pump chamber 3 is increased can be set without decreasing the value on the left side of Formula (3). Therefore, the discharge fluid volume per pumping period is increased, so that a pump having good drive efficiency can be provided.

Although, in the sixth exemplary embodiment, the pressure sensor 28 for the pump chamber 3 is used, the flow velocity sensor used in the fifth exemplary embodiment may also be used. By making use of the fact that the fluid volume velocity in the outlet flow path 2 starts to decrease when the pressure inside the pump chamber 3 becomes less than the load pressure $P_{fu}$ as shown in FIGS. 2 and 4, the same advantages can be provided when the process is carried out so that the applied voltage to the piezoelectric device 6 starts to fall at a timing in which the fluid volume velocity in the outlet flow path 2 starts to decrease.

When at least a half or more than half of the displacement amount of the actuator falls at this timing, substantially the same advantages can be provided.

[Advantages]

As described above, in the pump of the present invention, a valve is disposed only at the inlet flow path, that is, a fluid resistor, such as a valve, is only disposed at the inlet flow path, so that it is possible to reduce pressure loss at the fluid resistor and to make the pump more reliable.

A displacement enlarging mechanism is not disposed between a piston or the diaphragm and the actuator to drive the piston or diaphragm, and viscosity resistance is not made use of in the valve, so that the pump can be driven at a high frequency. By driving at a high frequency, it is possible to increase output of the pump. In particular, when a piezoelectric device or a giant magnetostrictive device is used as the actuator, the responsiveness of the device to high frequency can be sufficiently made use of, so that a small, light, high-output pump can be provided.

By controlling displacement, it is possible to increase the pressure inside the pump chamber to a high pressure, so that the pump can be used under high load pressure and drive efficiency can be increased by increasing the discharge fluid volume per period.

What is claimed is:

1. A pump, comprising:

a movable wall including at least a diaphragm;

an actuator to displace the movable wall;

a driving device to control driving of the actuator;

a pump chamber having a volume that is changeable by the displacement of the movable wall;

at least one inlet flow path to allow an operating fluid to flow into the pump chamber; and at least one outlet flow path to allow the operating fluid to flow out of the pump chamber, the outlet flow path being opened to the pump chamber during operation of the pump, a combined inertance value of the at least one inlet flow path being smaller than a combined inertance value of the at least one outlet flow path, and the inlet flow path having a fluid resistor to cause a resistance to the flow of the operating fluid to be smaller when the operating fluid flows into the pump chamber than when the operating fluid flows out of the pump chamber;

the driving device including a displacement controlling device to control movement of the movable wall based on detection information from pump pressure detecting means for detecting pressure inside the pump; and the displacement controlling device measuring time up to when the pump pressure detecting means detects a predetermined pressure change after completion of the displacement of the movable wall for one period, and controlling the movement of the movable wall based on information of the measured time.

2. The pump according to claim 1, the displacement controlling device controlling the movement of the movable wall so that the measured time becomes extended.

3. A pump, comprising:

a movable wall including at least a diaphragm;

an actuator to displace the movable wall;

a driving device to control driving of the actuator;

a pump chamber having a volume that is changeable by the displacement of the movable wall;

at least one inlet flow path to allow an operating fluid to flow into the pump chamber; and at least one outlet flow path to allow the operating fluid to flow out of the pump chamber, the outlet flow path being opened to the pump chamber during operation of the pump, a combined inertance value of the at least one inlet flow path being smaller than a combined inertance value of the at least one outlet flow path, and the inlet flow path having a fluid resistor to cause a resistance to the flow of the operating fluid to be smaller when the operating fluid flows into the pump chamber than when the operating fluid flows out of the pump chamber;

the driving device including a displacement controlling device to control movement of the movable wall based on detection information from pump pressure detecting means for detecting pressure inside the pump, and the displacement controlling device controlling the movement of the movable wall based on a calculation value using a predetermined value and a value detected by the pump pressure detecting device.

4. The pump according to claim 3, the calculation value being a value resulting from time-integrating a difference between the value detected by the pump pressure detecting device and the predetermined value for a period in which the value detected by the pump pressure detecting means is equal to or greater than the predetermined value.

5. The pump according to claim 4, the displacement controlling device controlling the movement of the movable wall so that the calculation value increases.

6. The pump according to claim 3, the predetermined value being a value measured by the pump pressure detecting device prior to driving the actuator.

7. The pump according to claim 3, the predetermined value being a value measured by the pump pressure detecting device when the driving of the actuator is stopped temporarily.

8. The pump according to claim 3, the predetermined value being a previously inputted value substantially equivalent to a load pressure at a location downstream from the outlet flow path.

9. The pump according to claim 3, the driving device further including a load pressure detecting device to detect a load pressure at a location downstream from the outlet flow path, and the predetermined value being a value measured by the load pressure detecting device.

10. A pump, comprising:

a movable wall including at least a diaphragm;

an actuator to displace the movable wall;

a driving device to control driving of the actuator;

a pump chamber having a volume that is changeable by the displacement of the movable wall;

at least one inlet flow path to allow an operating fluid to flow into the pump chamber; and at least one outlet flow path to allow the operating fluid to flow out of the pump chamber, the outlet flow path being opened to the pump chamber during operation of the pump, a combined inertance value of the at least one inlet flow path being smaller than a combined inertance value of the at least one outlet flow path, and the inlet flow path having a fluid resistor to cause a resistance to the flow of the operating fluid to be smaller when the operating fluid flows into the pump chamber than when the operating fluid flows out of the pump chamber;

the driving device including a displacement controlling device to control movement of the movable wall based on detection information from pump pressure detecting means for detecting pressure inside the pump, the displacement controlling device controlling a displacement velocity in the pump chamber volume reducing step of the movable wall by changing a displacement time of the movable wall while holding the reached-displacement-position of the movable wall constant.

11. A pump, comprising:

a movable wall including at least a diaphragm;

an actuator to displace the movable wall;

a driving device to control driving of the actuator;

a pump chamber having a volume that is changeable by the displacement of the movable wall;

at least one inlet flow path to allow an operating fluid to flow into the pump chamber; and at least one outlet flow path to allow the operating fluid to flow out of the pump chamber, the outlet flow path being opened to the pump chamber during operation of the pump, a combined inertance value of the at least one inlet flow path being smaller than a combined inertance value of the at least one outlet flow path, and the inlet flow path having a fluid resistor to cause a resistance to the flow of the operating fluid to be smaller when the operating fluid flows into the pump chamber than when the operating fluid flows out of the pump chamber;

the driving device including a displacement controlling device to control movement of the movable wall based on detection information from pump pressure detecting means for detecting pressure inside the pump, and the displacement controlling device performing a controlling operation so that the movable wall is displaced in a direction in which the volume of the pump chamber is increased after a reduction in the pressure detected by the pump pressure detecting device to a value less than a predetermined value.

* * * * *